US010632745B2

(12) United States Patent
Kiji

(10) Patent No.: US 10,632,745 B2
(45) Date of Patent: Apr. 28, 2020

(54) INKJET HEAD AND INKJET RECORDING APPARATUS

(71) Applicant: TOSHIBA TEC KABUSHIKI KAISHA, Shinagawa-ku, Tokyo (JP)

(72) Inventor: Yasuhito Kiji, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/242,041

(22) Filed: Jan. 8, 2019

(65) Prior Publication Data

US 2019/0217608 A1 Jul. 18, 2019

(30) Foreign Application Priority Data

Jan. 12, 2018 (JP) ..... 2018-003502

(51) Int. Cl.
*B41J 2/045* (2006.01)
*B41J 2/14* (2006.01)

(52) U.S. Cl.
CPC ..... *B41J 2/04588* (2013.01); *B41J 2/04541* (2013.01); *B41J 2/04581* (2013.01); *B41J 2/04591* (2013.01); *B41J 2/04595* (2013.01); *B41J 2/04596* (2013.01); *B41J 2/14209* (2013.01); *B41J 2002/14491* (2013.01); *B41J 2202/10* (2013.01); *B41J 2202/12* (2013.01)

(58) Field of Classification Search
CPC ..... B41J 2/04581; B41J 2/04588; B41J 2/04596; B41J 2/14233; B41J 2/04593; B41J 2/04541; B41J 2/14274; B41J 2/04595; B41J 2/04573; B41J 2/161; B41J 29/38; B41J 2002/14491; B41J 2/14314; B41J 2/14201; B41J 2/14209; B41J 2/04591; B41J 2202/10; B41J 2202/12; B41J 2/04598
See application file for complete search history.

(56) References Cited

U.S. PATENT DOCUMENTS 9,815,279 B1 11/2017 Kiji et al.
2012/0306954 A1* 12/2012 Nishikawa ..... B41J 2/04516 347/11
2013/0241985 A1* 9/2013 Furuno ..... B41J 2/04581 347/10
2018/0072055 A1 3/2018 Kiji

FOREIGN PATENT DOCUMENTS

JP 2012-45797 3/2012

* cited by examiner

*Primary Examiner* — Jannelle M Lebron
(74) *Attorney, Agent, or Firm* — Amin, Turocy & Watson, LLP

(57) ABSTRACT

An inkjet head comprises a pressure chamber that stores liquid; an actuator that changes a volume of the pressure chamber in response to an applied driving signal; and an applying section that applies the driving signal to the actuator. The driving signal includes a discharge pulse and an oscillation pulse. The discharge pulse enables liquid to be discharged from a nozzle communicating with the pressure chamber. The oscillation pulse is applied before the discharge pulse and has a potential opposite in polarity to that of the discharge pulse to generate pressure oscillation for promoting discharge of the liquid in the liquid. When the driving signal includes two or more successive discharge pulses, a cycle of the discharge pulse is 1.5 times or more and 2.5 times or less as long as a half cycle of a main acoustic resonance frequency of the liquid in the pressure chamber.

20 Claims, 14 Drawing Sheets

INKJET HEAD AND INKJET RECORDING APPARATUS

CROSS-REFERENCE TO RELATED APPLICATION

This application is based upon and claims the benefit of priority from Japanese Patent Application No. P2018 003502, filed on Jan. 12, 2018, the entire contents of which are incorporated herein by reference.

FIELD

Embodiments described herein relate generally to an inkjet head, an inkjet recording apparatus and methods related thereto.

BACKGROUND

A multi-drop type inkjet head adjusts an amount of liquid droplets by discharging one dot/drop of liquid droplet a plurality of times. In such an inkjet head, a drive device comprises a drive circuit for controlling discharge of liquid droplets. The drive circuit controls discharge of liquid droplets by outputting a high-frequency driving signal to an actuator of the inkjet head.

DETAILED DESCRIPTION

Figure 1:
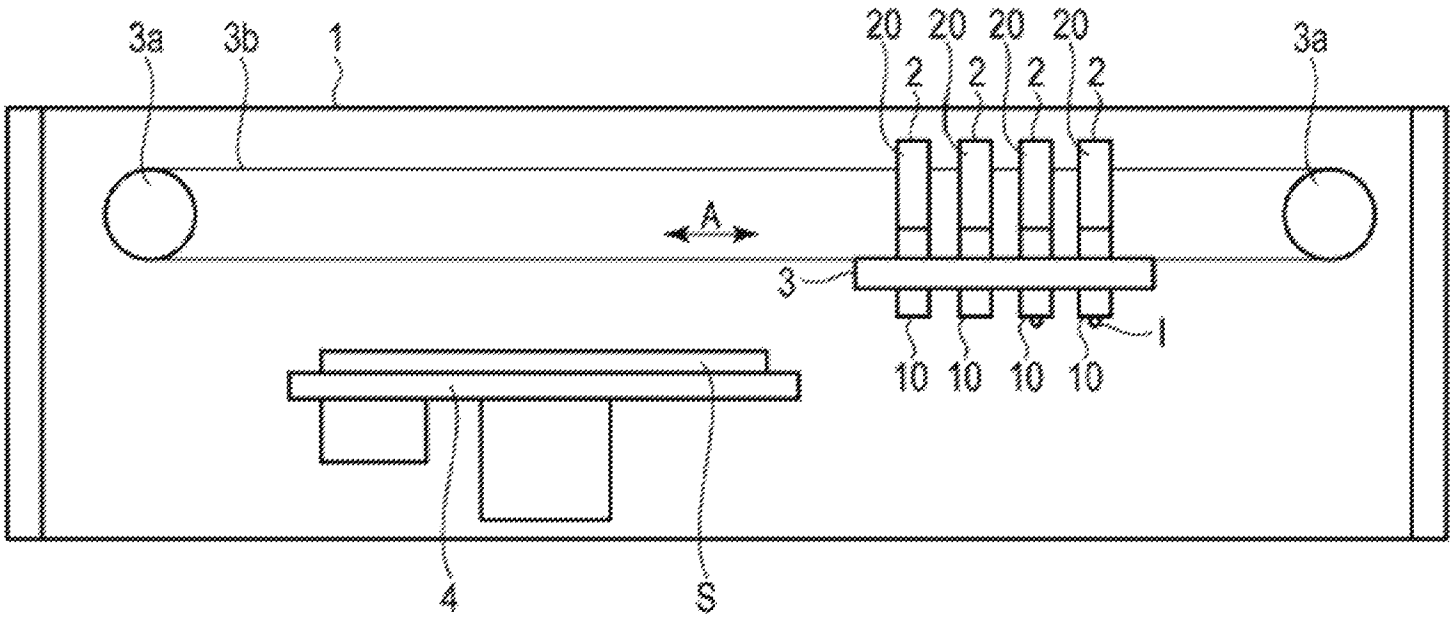
FIG. 1 is a schematic diagram illustrating an example of a configuration of an inkjet recording apparatus according to a first embodiment and a second embodiment.

In accordance with an embodiment, an inkjet head comprises a pressure chamber configured to store liquid; an actuator configured to change a volume of the pressure chamber in response to an applied driving signal; and an applying section configured to apply the driving signal to the actuator. The driving signal includes a discharge pulse and an oscillation pulse. The discharge pulse enables liquid to be discharged from a nozzle communicating with the pressure chamber. The oscillation pulse is applied before the discharge pulse and has a potential opposite in polarity to that of the discharge pulse to generate pressure oscillation for promoting discharge of the liquid in the liquid. When the driving signal includes two or more successive discharge pulses, a cycle of the discharge pulse is 1.5 times or more and 2.5 times or less as long as a half cycle of a main acoustic resonance frequency of the liquid in the pressure chamber.

Embodiments of the present invention are described below with reference to the accompanying drawings. The identical or equivalent parts in each drawing are denoted with the same reference numerals. For the convenience of description, in each drawing used for the description of the embodiments, the scales of the respective parts appropriately changed.

First Embodiment

FIG. 1 is a schematic diagram illustrating an example of a configuration of an inkjet recording apparatus 1 including an inkjet head according to the present embodiment.

The inkjet recording apparatus 1 forms an image on an image forming medium S using a liquid recording material such as ink. For example, the inkjet recording apparatus 1 includes a plurality of liquid discharge sections 2, a head support mechanism 3 movably supporting the liquid discharge section 2, and a medium support mechanism 4 movably supporting the image forming medium S. The image forming medium S is, for example, a sheet-like paper.

As shown in FIG. 1, a plurality of liquid discharge sections 2 is supported by the head support mechanism 3 by being arranged in parallel in a predetermined direction. The head support mechanism 3 is attached to a belt 3*b* hung on a roller 3*a*. The inkjet recording apparatus 1 can rotate the roller 3*a* to move the head support mechanism 3 in a main scanning direction A orthogonal to a conveyance direction of the image forming medium S. The liquid discharge section 2 includes an inkjet head 10 and an ink supply device 20, which are integrated with each other. The liquid discharge section 2 performs a discharge operation of discharging a liquid I such as ink from the inkjet head 10. For example, the inkjet recording apparatus 1 is of a scanning type in which an ink discharge operation is performed while reciprocating the head support mechanism 3 in the main scanning direction A to form a desired image on the image forming medium S facing the head support mechanism 3. Alternatively, the inkjet recording apparatus 1 may be of a single pass type in which the ink discharge operation is performed without moving the head support mechanism 3. In this case, it is not necessary to provide the roller 3*a* and the belt 3*b*. In this case, the head support mechanism 3 is fixed to a housing of the inkjet recording apparatus 1, for example.

The plurality of liquid discharge sections 2 corresponds to ink of four colors, i.e., CMYK (cyan, magenta, yellow and key (black)). Specifically, the plurality of liquid discharge sections 2 respectively corresponds to cyan ink, magenta ink, yellow ink and black ink. Then, the plurality of liquid discharge sections 2 discharges ink of corresponding colors, respectively. The liquid discharge section 2 can consecutively discharge one or a plurality of liquid droplets of the corresponding color for one pixel on the image forming medium S. The quantity of liquid droplets landing on one pixel is large for the pixel for which the number of times the liquid droplets are consecutively discharged is large. Therefore, the corresponding color appears dark for the pixel for which the number of times the liquid droplets are consecutively discharged is large. As a result, the inkjet recording apparatus 1 is capable of expressing gradation of an image formed on the image forming medium S.

Figure 2:
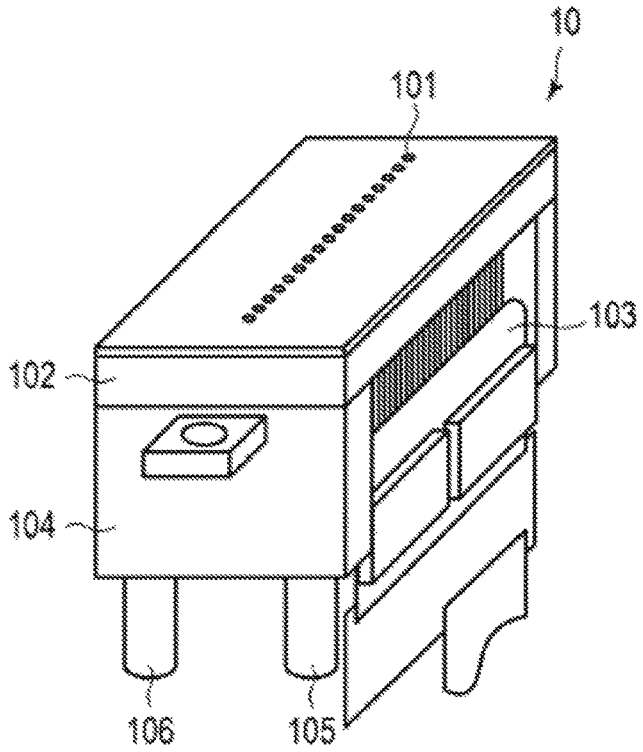
FIG. 2 is a perspective view illustrating an example of an inkjet head shown in FIG. 1.

FIG. 2 is a perspective view illustrating an example of the inkjet head 10. The inkjet head 10 comprises a nozzle 101, a head substrate 102, a drive circuit 103 and a manifold 104. The manifold 104 includes an ink supply port 105 and an ink discharge port 106.

The nozzle 101 is provided on the head substrate 102. The nozzles 101 are aligned in a line along a longitudinal direction of the head substrate 102. The drive circuit 103 is a driving signal output section that outputs a driving signal for discharging liquid droplets from the nozzle 101. The drive circuit 103 is, for example, a driver IC (integrated circuit). For example, the drive circuit 103 generates a driving signal based on waveform data. The ink supply port 105 supplies the ink to the nozzle 101. The ink discharge port 106 is used for discharging the ink. The nozzle 101 discharges liquid droplets supplied from the ink supply port 105 in response to the applied driving signal from the drive circuit 103. The ink that is not discharged from the nozzle 101 is discharged from the ink discharge port 106.

The drive circuit 103 is an example of an applying section.

Figure 3:
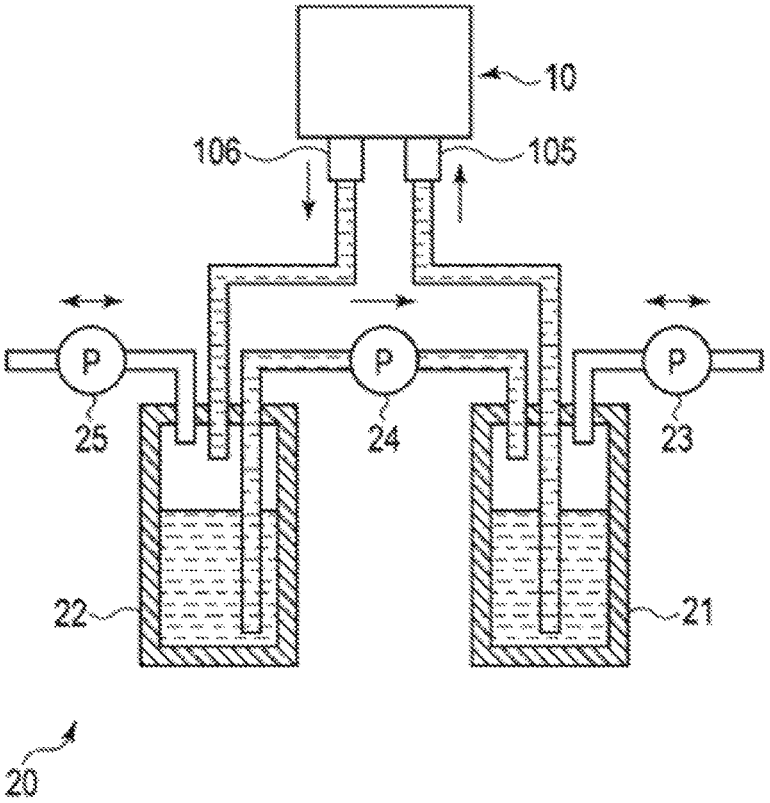
FIG. 3 is a schematic diagram illustrating an ink supply device shown in FIG. 1.

FIG. 3 is a schematic diagram of an ink supply device 20 used in the inkjet recording apparatus 1. The ink supply device 20 supplies the ink to the inkjet head 10. The ink supply device 20 comprises a supply side ink tank 21, a discharge side ink tank 22, a supply side pressure adjustment pump 23, a conveyance pump 24 and a discharge side pressure adjustment pump 25. These parts are connected by tubes through which the ink can flow. The supply side ink tank 21 is connected to the ink supply port 105 via the tube, and the discharge side ink tank 22 is connected to the ink discharge port 106 via the tube.

The supply side pressure adjustment pump 23 adjusts the pressure of the supply side ink tank 21. The discharge side pressure adjustment pump 25 adjusts the pressure of the discharge side ink tank 22. The supply side ink tank 21 supplies ink to the ink supply port 105 of the inkjet head 10. The discharge side ink tank 22 temporarily stores the ink discharged from the ink discharge port 106 of the inkjet head 10. The conveyance pump 24 returns the ink stored in the discharge side ink tank 22 to the supply side ink tank 21 via the tube.

Next, the inkjet head 10 is further described in detail.

Figure 4:
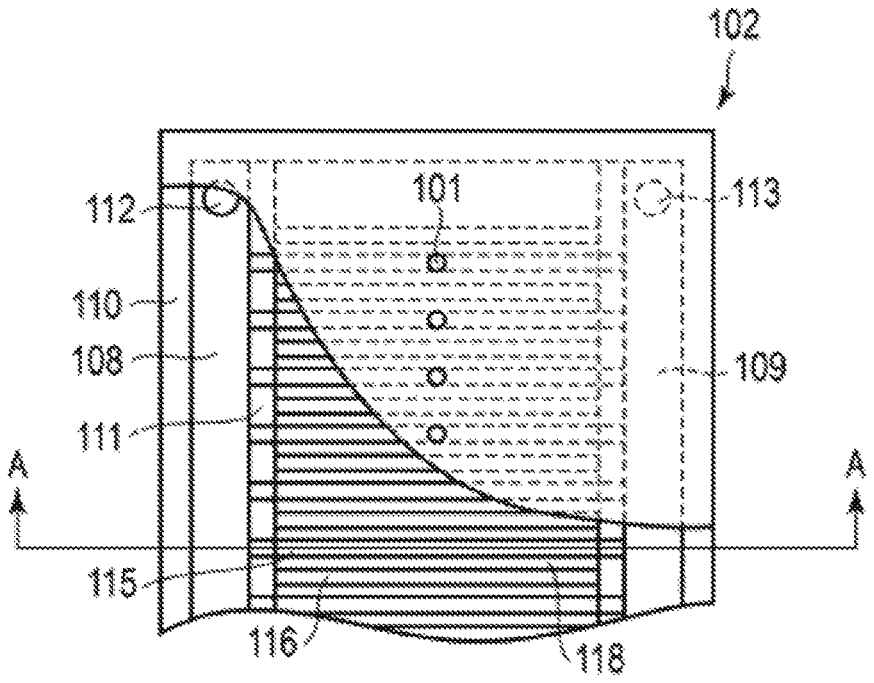
FIG. 4 is a plan view of a head substrate applicable to an inkjet head shown in FIG. 1.
Figure 5:
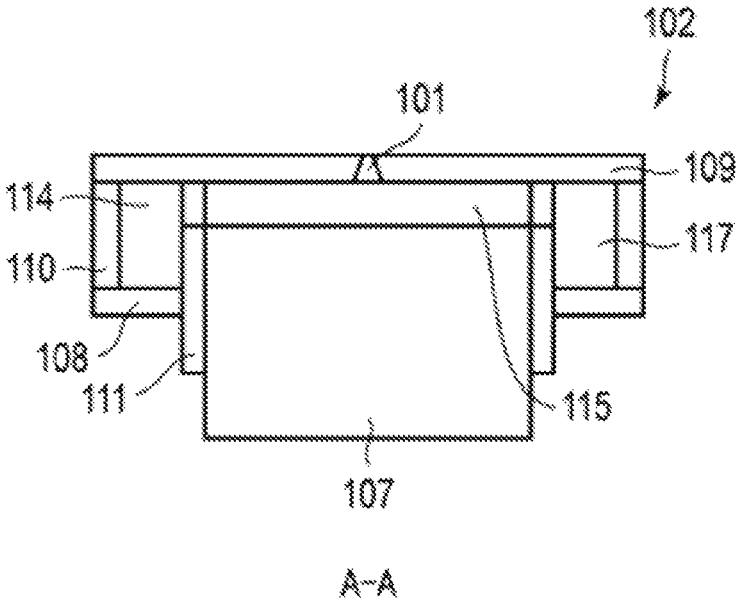
FIG. 5 is a cross-sectional view of the head substrate taken along a line A-A in FIG. 4.
Figure 6:
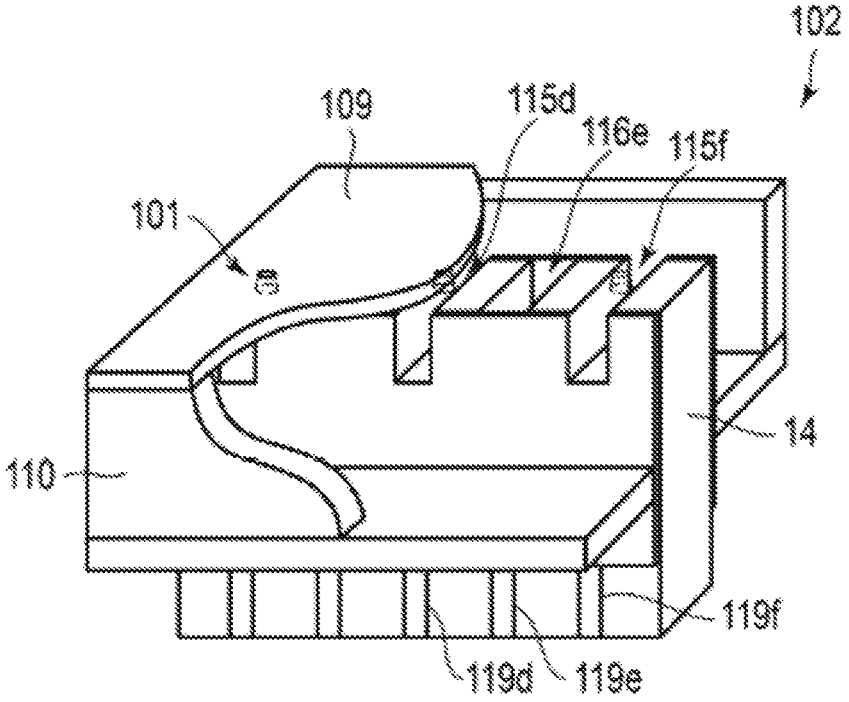
FIG. 6 is a perspective view of the head substrate shown in FIG. 4.

FIG. 4 is a plan view of the head substrate 102 applicable to the inkjet head 10. In FIG. 4, an internal structure of the head substrate 102 is shown while a lower left part of a nozzle plate 109 in the drawing is partially not shown. FIG. 5 is a cross-sectional view of the head substrate 102 taken along a line A-A in FIG. 4. FIG. 6 is a perspective view of the head substrate 102 shown in FIG. 4.

As shown in FIG. 4 and FIG. 5, the head substrate 102 includes a piezoelectric member 107, an ink flow path member 108, the nozzle plate 109, a frame member 110 and a substrate wall 111. An ink supply hole 112 and an ink discharge hole 113 are formed in the ink flow path member 108. An ink supply path 114 is surrounded by the ink flow path member 108, the nozzle plate 109, the frame member 110 and the substrate wall 111, and the ink supply hole 112 is formed therein. An ink discharge path 117 is surrounded by the ink flow path member 108, the nozzle plate 109, the frame member 110, and the substrate wall 111, and the ink discharge hole 113 is formed therein. The ink supply hole 112 communicates with the ink supply path 114. The ink discharge hole 113 communicates with the ink discharge path 117. The ink supply hole 112 is fluidly connected to the ink supply port 105 of the manifold 104. The ink discharge hole 113 is fluidly connected to the ink discharge port 106 of the manifold 104.

The piezoelectric member 107 has a plurality of elongated grooves extending from the ink supply path 114 to the ink discharge path 117. These elongated grooves become a part of a pressure chamber 115 or an air chamber 116. The pressure chamber 115 and the air chamber 116 are formed with one adjacent to the other. Specifically, in the piezoelectric member 107, the pressure chamber 115 and the air chamber 116 are alternately formed. The air chamber 116 is formed by sealing both ends of the elongated groove with the substrate wall 111. By sealing both ends of the elongated groove with the substrate wall 111, the ink in the ink supply path 114 and the ink discharge path 117 is prevented from flowing into the air chamber 116. A groove is formed in a portion of the substrate wall 111 that is in contact with the pressure chamber 115. As a result, the ink flows into the pressure chamber 115 from the ink supply path 114, and the ink is discharged from the pressure chamber 115 to the ink discharge path 117.

As shown in FIG. 6 to FIG. 9, wiring electrodes 119 (119*a*, 119*b*, . . . , 119*g*, . . . ) are formed in the piezoelectric member 107. On the inner surface of the piezoelectric member in each of the pressure chamber 115 and the air chamber 116, an electrode 120 described later is formed. The wiring electrode 119 electrically connects the electrode 120 and the drive circuit 103. It is preferable that the ink flow path member 108, the frame member 110 and the substrate wall 111 each are made of, for example, a material having a small dielectric constant and a small difference in thermal expansion coefficient from the piezoelectric member. As the material, for example, alumina ($Al_2O_3$), silicon nitride ($Si_3N_4$), silicon carbide (SiC), aluminum nitride (AlN), lead titanate zirconate (PZT), or the like may be provided. In the present embodiment, the ink flow path member 108, the frame member 110 and the substrate wall 111 are made of alumina ($Al_2O_3$).

Figure 7:
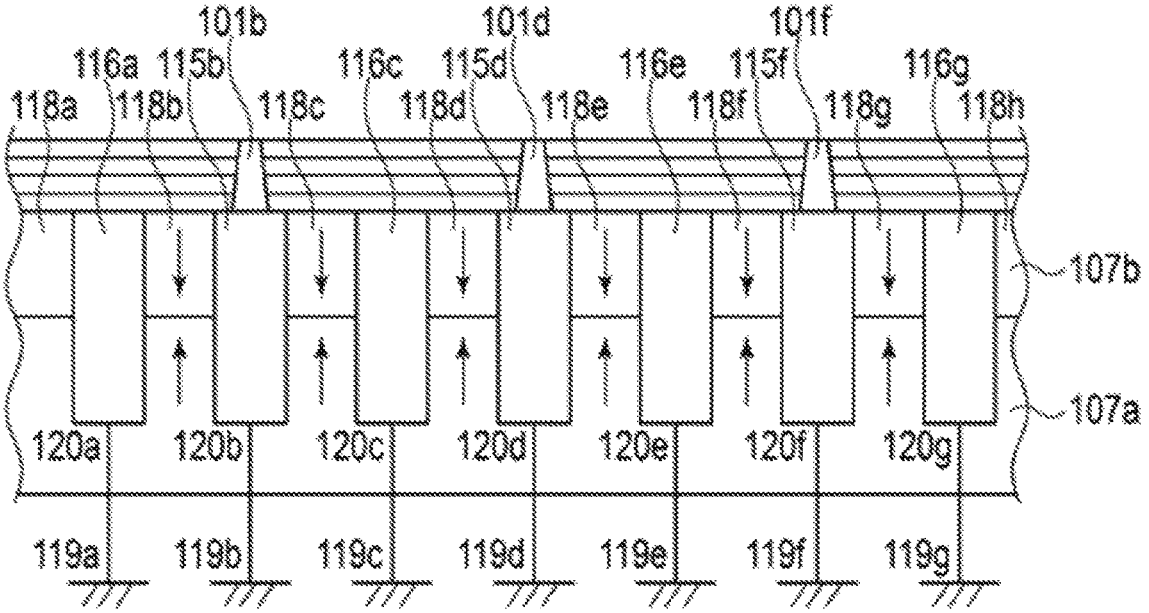
FIG. 7 is a diagram illustrating a state of a pressure chamber.
Figure 8:
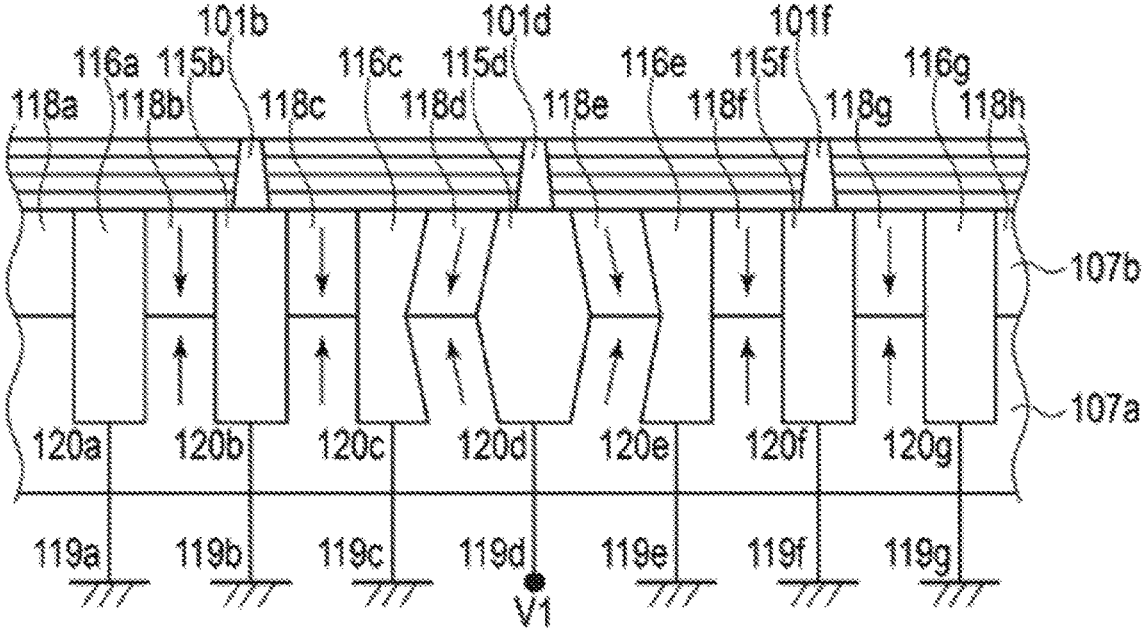
FIG. 8 is a diagram illustrating a state in which one pressure chamber is expanded.
Figure 9:
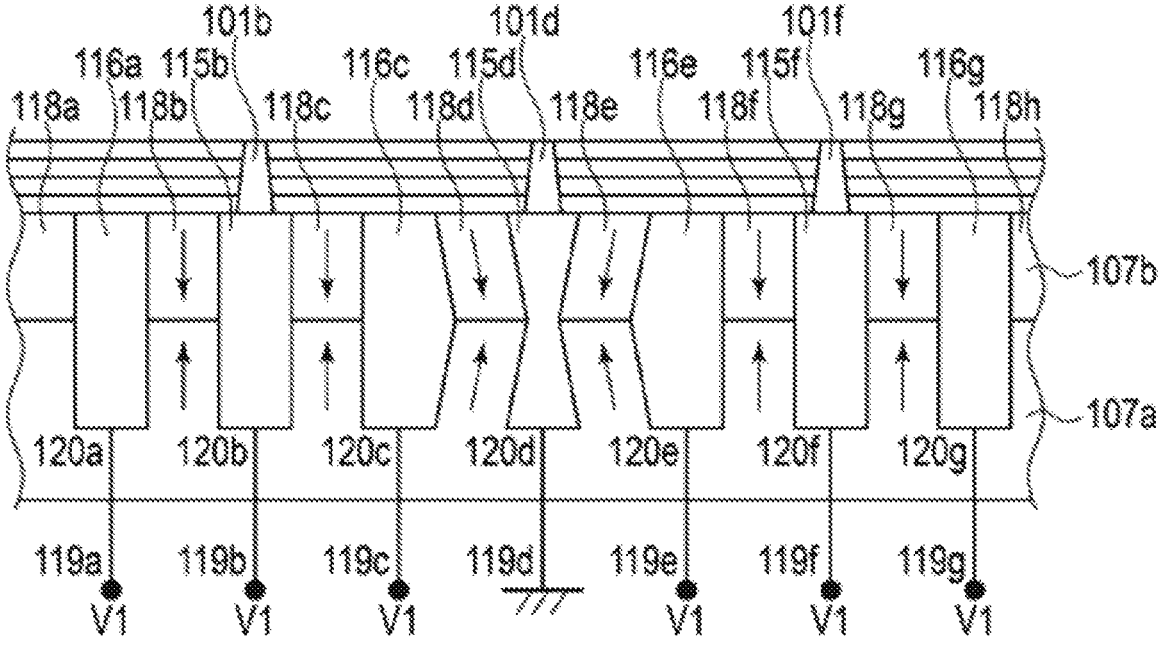
FIG. 9 is a diagram illustrating a state in which one pressure chamber is contracted.

As shown in FIG. 7 to FIG. 9, the piezoelectric member 107 is formed by laminating a piezoelectric member 107*a* and a piezoelectric member 107*b*. FIG. 7 to FIG. 9 are diagrams illustrating the state of the pressure chamber. The polarization directions of the piezoelectric member 107*a* and the piezoelectric member 107*b* are opposite to each other in a substrate thickness direction. In the piezoelectric member 107, a plurality of elongated grooves connecting the ink supply path 114 to the ink discharge path 117 is formed in parallel.

The electrodes 120 (120*a*, 120*b*, . . . , 120*g*, . . . ) are formed on the inner surfaces of the elongated grooves. The pressure chamber 115 and the air chamber 116 are surrounded by the elongated grooves and the one surface of the nozzle plate 109 covering the elongated grooves. In the example in FIG. 7, the pressure chambers 115 are denoted by reference numerals 115*b*, 115*d*, 115*f*, . . . , and the air chambers 116 are denoted by reference numerals 116*a*, 116*c*, 116*e*, 116*g*, . . . .

As described above, the pressure chamber 115 and the air chamber 116 are alternately arranged. The electrode 120 is connected to the drive circuit 103 through the wiring electrode 119. The piezoelectric member 107 constituting a partition wall of the pressure chamber 115 is sandwiched between the electrodes 120 provided on the inner surfaces of the elongated grooves. The piezoelectric member 107 and the electrode 120 constitute an actuator 118.

The drive circuit 103 applies an electric field to the actuator 118 according to a driving signal. Shearing deformation occurring in the actuator 118 with a jointed portion between the piezoelectric member 107*a* and the piezoelectric member 107*b* as a top portion is caused by the applied electric field as in the actuators 118*d* and 118*e* in FIG. 8. As the actuator 118 is deformed, a volume of the pressure chamber 115 changes. Due to the change in the volume of the pressure chamber 115, the ink in the pressure chamber 115 is pressurized or decompressed. By this pressurization or decompression, the ink is discharged from the nozzle 101. As the piezoelectric member 107, for example, lead titanate zirconate (PZT: $Pb(Zr, Ti)O_3$), lithium niobate ($LiNbO_3$), lithium tantalate ($LiTaO_3$) and the like may be provided. In the present embodiment, the piezoelectric member 107 is lead zirconate titanate (PZT) having a high piezoelectric constant.

The electrode 120 has a two-layer structure including nickel (Ni) and gold (Au). The electrode 120 is uniformly formed as a layer in the elongated groove by, for example, a plating method. As a method of forming the electrode 120, in addition to the plating method, a sputtering method or an evaporation method may be used. For example, the elongated groove has a shape of which the length is 1.5 to 2.5 mm, the depth is 150.0 to 300.0 μm and the width is 30.0 to 110.0 μm, and the elongated grooves are arranged in parallel at a pitch of 70 to 180 μm. As described above, the elongated groove becomes a part of the pressure chamber 115 or the air chamber 116. The pressure chamber 115 and the air chamber 116 are alternately arranged.

The nozzle plate 109 is bonded to the piezoelectric member 107. The nozzle 101 is formed in a central portion in the longitudinal direction of the pressure chamber 115 of the nozzle plate 109. The material of the nozzle plate 109 is, for example, metal material such as stainless steel, inorganic material such as single crystal silicon, or resin material such as polyimide film. In the present embodiment, for example, the material of the nozzle plate 109 is a polyimide film.

The inkjet head 10 described above has the ink supply path 114 at one end of the pressure chamber 115, the ink discharge path 117 at the other end, and a nozzle 101 at the center of the pressure chamber 115. The inkjet head 10 is not limited to such a configuration. For example, the inkjet head may have a nozzle at one end of the pressure chamber 115 and an ink supply path at the other end.

Next, an operation principle of the inkjet head 10 according to the present embodiment is described.

FIG. 7 shows the head substrate 102 in a state in which a ground voltage is applied to the electrodes 120*a* to 120*g* via the wiring electrodes 119*a* to 119*g*. In FIG. 7, since the electrodes 120*a* to 120*g* have the same potential, no electric field is applied to the actuators 118*a* to 118*h*. Therefore, the actuators 118*a* to 118*h* are not deformed.

FIG. 8 shows the head substrate 102 in a state in which a voltage V1 is applied only to the electrode 120*d*. In the state shown in FIG. 8, a potential difference is generated between the electrode 120*d* and the adjacent electrodes 120*c* and 120*e*. The actuator 118*d* and the actuator 118*e* are subject to the shearing deformation so as to expand the volume of the pressure chamber 115*d* according to the applied potential difference. Here, if the voltage of the electrode 120*d* is returned from the voltage V1 to the ground voltage, the states of the actuator 118*d* and the actuator 118*e* return from the states shown in FIG. 8 to the states shown in FIG. 7, thereby discharging the liquid droplets from a nozzle 101*d*.

In FIG. 9, the volume of the pressure chamber 115*d* is contracted. In FIG. 9, the actuator 118*d* and the actuator 118*e* are deformed into shapes opposite to those shown in FIG. 8.

FIG. 9 shows the head substrate 102 in a state in which the ground voltage is applied to the electrode 120*d* and the voltage V1 is applied to the electrodes 120*a*, 120*c*, 120*e* and 120*g* of the air chamber 116*a*, the air chamber 116*c*, the air chamber 116*e* and the air chamber 116*g*, respectively. In the state shown in FIG. 9, a potential difference opposite to that in FIG. 8 (opposite electric field) is generated between the electrode 120*d* and the adjacent electrodes 120*c* and 120*e*. Due to the potential difference, the actuator 118*d* and the actuator 118*e* are subject to the shearing deformation in a direction opposite to that shown in FIG. 8. FIG. 9 shows a state in which the voltage V1 is also applied to the electrode 120*b* and the electrode 120*f*. As a result, the actuator 118*b*, the actuator 118*c*, the actuator 118*f*, and the actuator 118*g* are not deformed. If the actuator 118*b*, the actuator 118*c*, the actuator 118*f* and the actuator 118*g* are not deformed, the pressure chamber 115*b* and the pressure chamber 115*f* are not contracted.

In the actuator 118*d*, the electrode 120*d* is an example of a first electrode. The electrode 120*c* is an example of a second electrode. In the actuator 118*e*, the electrode 120*d* is an example of a first electrode. The electrode 120*e* is an example of a second electrode.

Figure 10:
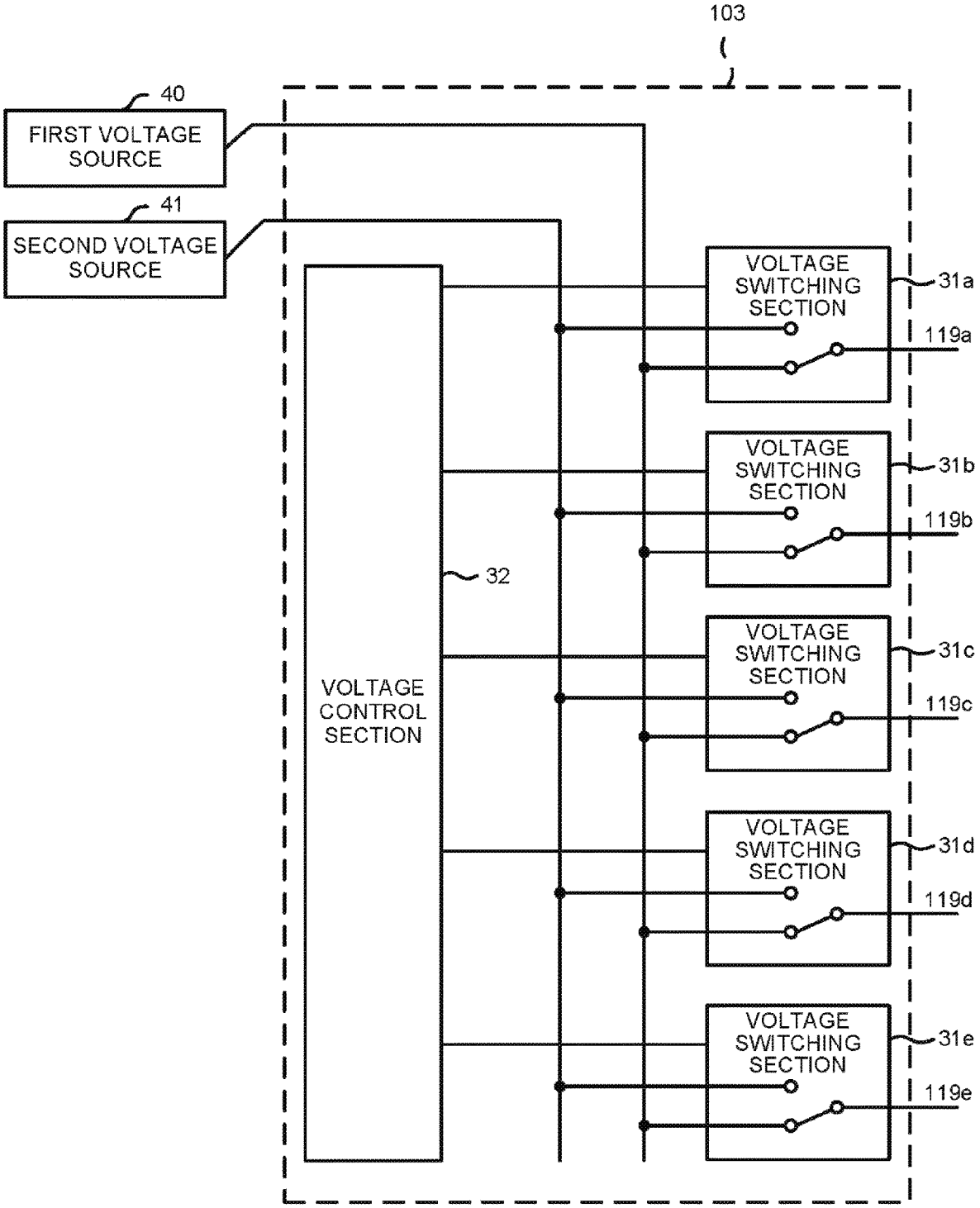
FIG. 10 is a diagram illustrating an example of a configuration of a drive circuit according to the first embodiment.

FIG. 10 is a diagram illustrating an example of a configuration of the drive circuit 103. The drive circuit 103 has voltage switching sections 31, the number of which is equal to the total number of pressure chambers 115 and air chambers 116 in the inkjet head 10, but in the configuration shown in FIG. 10, the voltage switching sections 31 are indicated by 31*a*, 31*b*, . . . , 31*e*. The drive circuit 103 comprises a voltage control section 32.

The drive circuit 103 is connected to a first voltage source 40 and a second voltage source 41. The drive circuit 103 selectively applies voltages supplied from the first voltage source 40 and the second voltage source 41 to each wiring electrode 119. In the example shown in FIG. 10, an output voltage of the first voltage source 40 is a ground voltage with a voltage value of V0 (V0=0[V]). The output voltage of the second voltage source 41 is set to a voltage value V1 higher than the voltage value V0.

The voltage switching section 31 is, for example, a semiconductor switch. The voltage switching section 31*a*, the voltage switching section 31*b*, . . . , the voltage switching section 31*e* are connected to a wiring electrode 119*a*, a wiring electrode 119*b*, . . . , a wiring electrode 119*e*, respectively. The voltage switching section 31 is connected to the first voltage source 40 and the second voltage source 41 via the wiring drawn into the drive circuit 103. The voltage switching section 31 has a changeover switch for switching the voltage source connected to the wiring electrode 119. The voltage switching section 31 uses the switch to switch the voltage source connected to the wiring electrode 119. For example, the voltage switching section 31*a* connects one of the first voltage source 40 and the second voltage source 41 to the wiring electrode 119*a* by a change-over switch.

The voltage control section 32 is connected to the voltage switching section 31*a*, the voltage switching section 31*b*, . . . , the voltage switching section 31*e*, respectively. The voltage control section 32 outputs a command indicating selection of the voltage source between the first voltage source 40 and the second voltage source 41 to each of the voltage switching sections 31. For example, the voltage control section 32 receives print data from an external device of the drive circuit 103 to determine a timing of switching the voltage source for each of the voltage switching sections 31. Then, the voltage control section 32 outputs a command to select either the first voltage source 40 or the second voltage source 41 to the voltage switching section 31 at the determined switching timing. The voltage switching section 31 switches the voltage source connected to the wiring electrode 119 according to the command from the voltage control section 32.

The first voltage source 40 is an example of a first voltage source. The second voltage source 41 is an example of a second voltage source.

Figure 11:
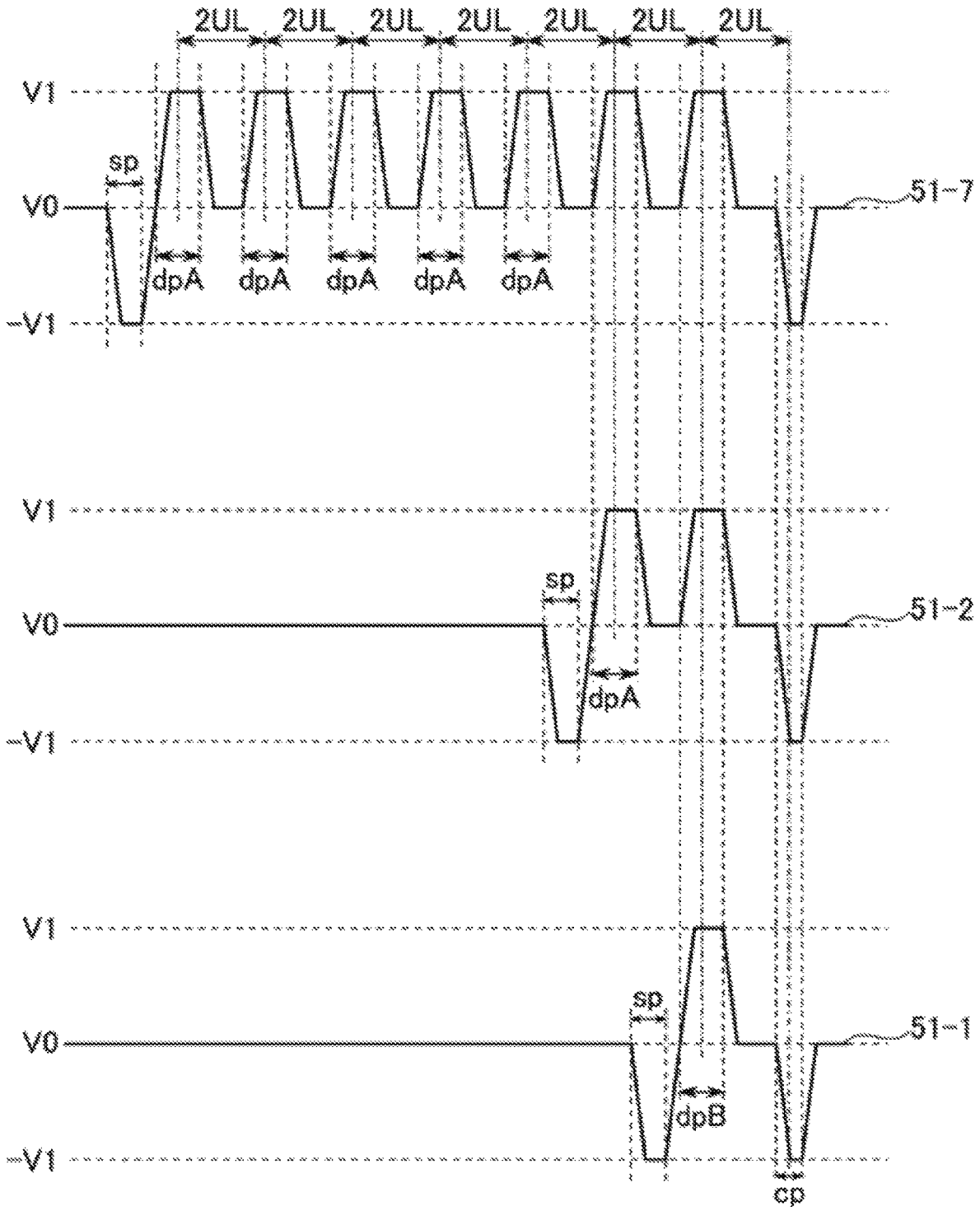
FIG. 11 is a diagram illustrating an example of a driving waveform according to the first embodiment.

FIG. 11 is a diagram illustrating an example of a driving waveform of the driving signal that the drive circuit 103 applies to the electrode 120. The driving waveform 51-7 is an example of a driving waveform when seven liquid droplets are consecutively discharged. The driving waveform 51-2 is an example of a driving waveform when two liquid droplets are consecutively discharged. The driving waveform 51-1 is an example of a driving waveform when one liquid droplet is discharged. The illustration of the driving waveform 51-3 to the driving waveform 51-6 when the number of liquid droplets to be consecutively discharged is three to six is omitted. The driving waveform 51-1 to the driving waveform 51-7 are collectively referred to as a driving waveform 51.

In FIG. 11, a horizontal axis indicates time and a vertical axis indicates voltage. The voltage is a voltage of the electrode 120 to which the driving waveform 51 is applied. The voltage of the electrode 120 is a potential with potentials of the wiring electrodes 119 connected to the electrodes 120 on the inner walls of the adjacent air chambers 116 as a reference. It is assumed that the driving waveform 51 shown in FIG. 11 is applied to the electrode 120*d* shown in FIG. 7. The adjacent air chambers of the electrode 120*d* are the air chamber 116*c* and the air chamber 116*e*. The electrodes on the inner walls of the adjacent air chambers 116*c* and 116*e* are the electrode 120*c* and the electrode 120*e*, and the wiring electrodes connected to the electrode 120*c* and the electrode 120*e* are the wiring electrode 119*c* and the wiring electrode 119*e*. Therefore, when the driving waveform 51 is applied to the electrode 120*d*, the voltage shown in FIG. 11 is a potential of the electrode 120*d* with the potentials of the wiring electrode 119*c* and the wiring electrode 119*e* (the electrode 120*c* and the electrode 120*e*) as a reference.

When the voltage in the driving waveform 51 applied to the electrode 120*d* is 0, the pressure chamber 115*d* enters the state shown in FIG. 7, and the volume thereof does not change. When the voltage in the driving waveform 51 applied to the electrode 120*d* is V1, the pressure chamber 115*d* enters the state shown in FIG. 8, and the volume thereof is expanded. Further, when the voltage in the driving waveform 51 applied to the electrode 120*d* is −V1, the pressure chamber 115*d* enters the state shown in FIG. 9 and the volume thereof is contracted.

The driving waveform 51 includes an oscillation pulse, a discharge pulse and a suppression pulse in this order. The oscillation pulse is applied to generate pressure oscillation to promote discharge of the liquid droplet. The discharge pulse is applied to discharge the liquid droplet from the nozzle 101. The suppression pulse is applied to suppress residual oscillation.

The oscillation pulse, the discharge pulse and the suppression pulse are rectangular waves if rise time and fall time are ignored. However, since there is a rise time and a fall time, the oscillation pulse, the discharge pulse and the suppression pulse are substantially trapezoidal waveforms, and thus, it can be said that they are trapezoidal waves.

The driving waveform 51-1 includes one discharge pulse, the driving waveform 51-2 includes two consecutive discharge pulses, . . . , and the driving waveform 51-7 includes seven consecutive discharge pulses. For example, the driving waveform 51-7 shown in FIG. 11 includes the oscillation pulse, the first discharge pulse to the seventh discharge pulse, and the suppression pulse in this order. The driving waveform 51-2 includes the oscillation pulse, the first discharge pulse, the second discharge pulse and the suppression pulse in this order. The driving waveform 51-1 includes the oscillation pulse, the first discharge pulse and the suppression pulse in this order. The last discharge pulse among the consecutive discharge pulses is hereinafter simply referred to as the "last discharge pulse". However, in a driving waveform which includes only one discharge pulse like the driving waveform 51-1, the one discharge pulse is the last discharge pulse. The discharge pulse other than the last discharge pulse is hereinafter referred to as a "discharge pulse other than the last". For example, in the driving waveform 51-7, the first discharge pulse to the sixth the discharge pulse are the discharge pulses other than the last, and the seventh discharge pulse is the last discharge pulse. The first discharge pulse is the initial discharge pulse.

The driving waveform 51 is further described by taking the driving waveform 51-2 as an example.

The drive circuit 103 first starts applying the oscillation pulse. For example, the oscillation pulse is a trapezoidal wave having a sp width in which the voltage changes in the order of 0, −V1, 0. The width indicates a time interval from the start of the application of the pulse to the end of the application thereof. Therefore, the sp width means that the time interval from the start of application of the pulse to the end of application of the pulse is sp. As the application of the oscillation pulse is started, the voltage of the electrode 120*d* changes from 0 to −V1. Then, the voltage of the electrode 120*d* is kept at −V1 until the end of application of the oscillation pulse. The sum of a time interval until the voltage of the electrode 120*d* falls from 0 to −V1 and a time interval in which the voltage of the electrode 120*d* is kept at −V1 is the time interval sp.

As the application of the oscillation pulse is started, the volume of the pressure chamber 115*d* is contracted, and the liquid in the pressure chamber 115*d* is pressurized. The pressurization caused by the oscillation pulse at the start of application is to such an extent that no liquid droplet is discharged from the nozzle 101.

The drive circuit 103 ends the application of the oscillation pulse after a predetermined time interval sp elapses from the start of the application of the oscillation pulse. The drive circuit 103 then starts applying the first discharge pulse. In the driving waveform 51-2, the first discharge pulse is the discharge pulse other than the last. For example, the discharge pulse other than the last is a trapezoidal wave having a width of dpA and in which the voltage changes in the order of 0, V1 and 0. Therefore, the discharge pulse and the oscillation pulse have opposite potentials. As the application of the oscillation pulse is ended and application of the discharge pulse is started, the voltage of the electrode 120*d* changes from −V1 to V1 via 0. Then, the voltage of the electrode 120*d* is kept at V1 until the application of the first pulse is ended. The sum of the time interval since the voltage of the electrode 120*d* rises from 0 to V1 and a time interval in which the voltage of the electrode 120*d* is kept at V1 is a time interval dpA.

If the application of the oscillation pulse is ended and application of the first discharge pulse is started, the volume of the pressure chamber 115*d* is expanded, and the liquid in the pressure chamber 115*d* is depressurized.

The drive circuit 103 ends the application of the first discharge pulse after a predetermined time interval dpA elapses from the start of application of the first discharge pulse. As the application of the discharge pulse is ended, the voltage of the electrode 120*d* changes from V1 to 0. The voltage of the electrode 120*d* is kept at 0 until the application of a next pulse is started.

When the application of the discharge pulse is ended, the volume of the pressure chamber 115*d* is contracted, and the liquid in the pressure chamber 115*d* is pressurized. As a result, the liquid in the pressure chamber 115*d* is discharged as the liquid droplet from the nozzle 101.

If the voltage falls from 0 to V1 due to the start of the application of the oscillation pulse and the voltage rises from −V1 to V1 due to the end of the application of the oscillation pulse and the start of the application of the first discharge pulse, the pressure oscillation is generated in the liquid in the pressure chamber 115*d*. In accordance with the pressure oscillation, by decreasing the voltage of the electrode 120*d* from V1 to 0, a force for discharging the liquid droplet can be increased. Therefore, by setting the time interval sp and the time interval dpA close to a half cycle AL of the pressure oscillation of the liquid in the pressure chamber 115, the discharge force generated according to the first discharge pulse can be increased. In order to obtain a strong discharge force, the time interval sp and the time interval dpA are both set in a range from 0.5 AL or more to 1.5AL or less, and the time interval sp and the time interval dpA are coincident with the AL, thereby maximizing the discharge force generated according to the first discharge pulse. The half cycle AL of the pressure oscillation is half a natural oscillation cycle (cycle at a main acoustic resonance frequency) of the liquid in the pressure chamber 115.

Next, the drive circuit 103 starts applying the second discharge pulse after a predetermined time interval elapses after the end of application of the first discharge pulse. Specifically, the drive circuit 103 starts applying the second discharge pulse so that a time interval from the center of the first discharge pulse to the center of the second discharge pulse is a predetermined time interval 2UL. The center of the pulse refers to a center time point between the start of application of the pulse and the end of the application thereof. In the driving waveform 51-2, the second discharge pulse is the last discharge pulse. The last discharge pulse is, for example, a trapezoidal wave having a width of dpB and in which the voltage changes in the order of 0, V1 and 0. Therefore, the potential of the last discharge pulse is opposite to that of the oscillation pulse. As the application of the last discharge pulse is started, the voltage of the electrode 120*d* changes from 0 to V1. Then, the voltage of the electrode 120*d* is kept at V1 until the application of the last discharge pulse is ended. The sum of a time interval since the voltage of the electrode 120*d* rises from 0 to V1 and a time interval in which the voltage of the electrode 120*d* is kept at V1 is a time interval dpB.

The discharge force generated according to the second discharge pulse can be increased by starting applying the second discharge pulse in accordance with a timing at which the oscillation is generated in the pressure chamber 115*d* by the first discharge pulse. Therefore, it is preferable to set the time interval 2UL to 2AL.

The drive circuit 103 ends the application of the last discharge pulse after a lapse of a predetermined time interval dpB from the start of application of the last discharge pulse. As the application of the last discharge pulse is ended, the voltage of the electrode 120*d* changes from V1 to 0. Then, the voltage of the electrode 120*d* is kept at 0 until the application of the suppression pulse is started. In order to obtain the strong discharge force, it is preferable that the time interval dpB is in a range of 0.5AL or more and 1.5AL or less, and the length of the time interval dpB is AL. By setting the length of the time interval dpB close to AL, the discharge force generated according to the last discharge pulse can be increased.

Next, the drive circuit 103 starts applying the suppression pulse after a predetermined time interval elapses after the application of the last discharge pulse is ended. Specifically, the drive circuit 103 starts applying the second discharge pulse so that a time interval from the center of the last discharge pulse to the center of the suppression pulse is a predetermined time interval 2UL. For example, the suppression pulse is a cp-width trapezoidal wave whose voltage changes in the order of 0, −V1 and 0. As the application of the suppression pulse is started, the voltage of the electrode 120*d* changes from 0 to −V1. Then, the voltage of the electrode 120*d* is kept at −V1 until the application of the suppression pulse is ended. The sum of a time interval until the voltage of the electrode 120*d* falls from 0 to −V1 and a time interval in which the voltage of the electrode 120*d* is kept at −V1 is a time interval cp.

It is preferable to set the time interval 2UL to 2AL. If the time interval 2UL is 2AL, the oscillation having a phase opposite to the oscillation generated by the last discharge pulse occurs in the pressure chamber 115*d* by the suppression pulse, and the residual oscillation in the pressure chamber 115*d* is suppressed. The length of time interval cp is preferably adjusted according to the degree of residual oscillation in the pressure chamber 115*d*.

The drive circuit 103 applies the driving waveform to the electrode 120*d* in the driving waveform 51-1 and the driving waveform 51-3 to the driving waveform 51-7, as in the case of the driving waveform 51-2. However, when the driving waveform 51-1 is applied, since the first discharge pulse is the last discharge pulse, the drive circuit 103 applies the suppression pulse next to the first discharge pulse. The drive circuit 103 sets a time interval from the center of the nth discharge pulse to the center of the (n+1)th discharge pulse is the predetermined time interval 2UL. However, n is an integer of 1 to 6.

The discharge force generated according to the (n+1)th discharge pulse can be increased by starting applying the (n+1)th discharge pulse in accordance with a timing of the oscillation generated in the pressure chamber 115*d* by the nth discharge pulse. Therefore, it is preferable that a time interval from the center of the nth discharge pulse to the center of the (n+1)th discharge pulse is 2AL. In other words, the time interval 2UL is preferably 2AL.

In the above description, the electrode 120*d* is described as a representative, but the same process is applicable to the electrode 120*b*, the electrode 120*d*, the electrode 120*f*, . . . .

As described above, the liquid discharge section 2 can express the gradation by changing the number of liquid droplets landing on one pixel which is the number of liquid droplets that are consecutively discharged to the image forming medium S. In the first embodiment, there are eight stages from 0 to 7. When the liquid droplets are landed on the image forming medium S while the image forming medium S is conveyed in a direction perpendicular to the discharge direction of the liquid droplet, it is desirable that the shift in the landing positions of the consecutively discharged liquid droplets on the image forming medium S is small. In order to reduce the shift in the landing position, it is desirable that a speed of the subsequently discharged liquid droplet among the consecutively discharged liquid droplets is equal to or higher than that of the previously discharged liquid droplet.

Therefore, it is considered to adjust the speed of the liquid droplet discharged according to the driving waveform.

First, the driving waveform 51-2 for consecutively discharging two liquid droplets is considered. The pressure oscillation in the pressure chamber 115 generated according to the oscillation pulse and the first discharge pulse is attenuated as the first liquid droplet is discharged from the nozzle 101. The pressure oscillation is attenuated due to viscous resistance in the pressure chamber 115. Here, at a timing at which the time interval from the center of the first discharge pulse to the center of the second discharge pulse becomes the time interval 2UL, the second discharge pulse which is the last discharge pulse is applied. As a result, it is possible to compensate for the attenuation of the pressure oscillation for the pressure oscillation attenuated by the above factors. As a result, a discharge force for discharging the second liquid droplet is obtained. If the attenuation of pressure oscillation and the increase of the pressure oscillation by the second discharge pulse are the same, the discharge speeds of the first liquid droplet and the second liquid droplet are almost the same. In other words, the second discharge pulse plays a role of maintaining the pressure oscillation necessary for discharging the second liquid droplet.

Here, for example, it is considered to set the width sp of the oscillation pulse to be smaller or larger than AL. In this way, a phase of the pressure oscillation generated in the pressure chamber 115 by the oscillation pulse and a phase of the pressure oscillation occurring in the pressure chamber 115 by the first pulse are shifted from each other. Therefore, by setting the width sp of the oscillation pulse to be smaller or larger than AL, the discharge speed of the first liquid droplet can be smaller than that in a case in which the width sp of the oscillation pulse is AL.

By setting the width dpB of the second discharge pulse which is the last discharge pulse to be smaller or larger than AL, the discharge speed of the second liquid droplet can be reduced. Even if the width dpA of the first discharge pulse and the width dpB of the second discharge pulse are the same, and both the width dpA and the width dpB are smaller or larger than AL, the discharge speed of the second liquid droplet can be smaller than that of the first liquid droplet. However, in terms of reduction of the voltage V1, the width dpA and the width dpB are preferably close to AL, and more preferably coincident with AL. This is because the discharge force increases as the width dpA and the width dpB coincide with AL. The influence of change in the width sp is most significant for the first liquid droplet. Therefore, it is preferable to change the width sp to adjust the speed difference between the speed of the first liquid droplet and the speed of the second liquid droplet.

Further, by setting the time interval 2UL from the center of the first discharge pulse to the center of the second discharge pulse to be smaller or larger than 2AL, the discharge speed of the second liquid droplet can be adjusted. However, in order to strengthen the pressure oscillation in the pressure chamber 115 generated by the oscillation pulse and the first discharge pulse using the pressure oscillation generated by the second discharge pulse, the time interval 2UL is within a range of 1.5AL to 2.5AL. When the time interval 2UL is less than 1.5AL or in the range of 2.5AL to 3.5AL, the pressure oscillation generated by the second discharge pulse has inverted phase with respect to the pressure oscillation generated by the first discharge pulse, and thus, the pressure oscillation cannot be strengthened. In another embodiment, the time interval 2UL is within a range of 1.75AL to 2.25AL.

Next, the driving waveform 51-7 for consecutively discharging seven liquid droplets is considered. The seven liquid droplets are discharged from the nozzle 101 at a timing at which the voltage falls from V1 to 0 in each of the first discharge pulse to the seventh discharge pulse. Here, when the time interval 2UL is 2AL, a ratio of the speed of the liquid droplet discharged in the second half to that of the liquid droplet discharged at the beginning (the speed of the liquid droplet in the second half/the speed of the liquid droplet at the beginning) becomes large.

Similarly to the driving waveform 51-2, the second and subsequent discharge pulses of the driving waveform 51-7 play a role of maintaining pressure oscillation necessary for discharging the second and subsequent liquid droplets. If the resistance occurring in the flow path in the inkjet head 10, such as the pressure chamber 115, is low due to the viscosity of the liquid or the structure of the flow path, the discharge force applied to maintain the pressure oscillation necessary for discharging the second and subsequent liquid droplets is reduced, and thus, the pressure oscillation can be maintained by setting the width dpA and the width dpB to be smaller or larger than AL. However, in terms of reduction of the voltage V1, the width dpA and the width dpB are preferably close to AL, and more preferably coincide with AL. For this reason, it is preferable to adjust the speed difference between the speed of the first liquid droplet and the speed of the second and subsequent liquid droplets by first changing the width sp, and then using the width dpA and the width dpB if a desired speed difference is not obtained after adjusting the width sp.

By setting the time interval 2UL to be smaller or larger than 2AL, it is possible to adjust the discharge speed of the second and subsequent liquid droplets. However, since the residual oscillation (pressure oscillation) generated by the nth discharge pulse is strengthened by the pressure oscillation generated by the (n+1)th discharge pulse, it is preferable that the time interval 2UL is within the range of 1.5AL to 2.5AL.

With the driving waveform of the present embodiment, the discharge force is obtained by matching the phases of the residual oscillation in the pressure chamber 115 and the discharge waveform. The magnitude of the residual oscillation generated by applying the driving waveform varies depending on the viscosity of the liquid to be discharged, the flow path structure of the inkjet head, the material of the flow path of the inkjet head and the like. Therefore, it is necessary to adjust ratios of respective waveform parameters such as the time interval sp, the time interval dpA, the time interval dpB, the time interval UL and the time interval cp of the driving waveform according to the viscosity of the liquid, the type of the inkjet head and the like.

EXAMPLES

The best mode for carrying out the above embodiment is described using the example. The example does not intend to limit the scope of the above embodiment.

In the example, the liquid of which a viscosity is about 10 mPas and a specific gravity is about 0.85 is discharged by a preproduction inkjet head 10. Among the nozzles 101 arranged in a line in the inkjet head 10, nine consecutive nozzles 101 are driven using the same driving waveform 51, and the liquid discharged from the middle one of the nine nozzles 101 is an observation target. The AL in the example is about 2 μs.

Here, if the actuator is considered as a capacitor and an internal resistance of the drive circuit 103, a wiring resistance and other energy loss are considered as resistance, a circuit for connecting the voltage source, the drive circuit 103, the wiring electrode 119 and the actuator can be considered as an RC (resistance-capacitor) series circuit. A case in which the voltage source is switched in this RC series circuit is considered. The rise time and the fall time of each trapezoidal wave of the driving waveform correlate with a time constant of the RC circuit, and a charge time or a discharge time required for change in the voltage in the capacitor when the voltage source connected to the capacitor changes. In the example, the rise time and the fall time of each trapezoidal wave of the driving waveform 51 are about 0.2 μs.

Experiment 1

Table 1 shows a value of the voltage V1 at which the discharge speed of the main liquid droplet discharged according to the driving waveform 51-1 by the inkjet head 10 in the example is about 8.5 m/s. Depending on a value of each waveform parameter of the driving waveform 51-1, the voltage V1 changes. Therefore, in Table 1, a vertical axis indicates the time interval UL and a horizontal axis indicates a ratio (sp/UL) of the time interval sp to the time interval UL. Table 1 shows the voltages V1 of nine combinations when the time interval UL is 1.9, 2.0 and 2.1, and sp/UL is 0.8, 0.7 and 0.6. The time interval dpB and the time interval UL are the same value. The time interval cp is 0.4 times the time interval UL.

TABLE 1 voltage v1 when discharge speed of liquid droplet according to the driving waveform 51-1 is about 8.5 m/s

| | | Sp/UL | | |
|---|---|---|---|---|
| | | 0.8 | 0.7 | 0.6 |
| UL (μs) | 2.1 | 18.2 | 18.2 | 18.8 |
| | 2.0 | 18.2 | 18.6 | 19.4 |
| | 1.9 | 18.6 | 18.8 | 19.4 |

dpB = UL
cp = 0.4UL

From Table 1, it can be known that the voltage V1 becomes smaller as the time interval UL is closer to AL and the time interval sp is closer to AL. In the following Experiment 2 and Experiment 3, the value of the voltage V1 of the driving waveform 51 is as shown in Table 1 regardless of the number of liquid droplets to be consecutively discharged. For example, under the condition of "UL=2.0 μs and sp/UL=0.8", the voltage V1 in both the driving waveform 51-1 and the driving waveform 51-7 is 18.2 V. For example, under the condition of "UL=1.9 μs and sp/UL=0.7", the voltage V1 in both the driving waveform 51-1 and the driving waveform 51-7 is 18.8 V.

Experiment 2

The liquid droplets are discharged by the inkjet head 10 in the example according to the driving waveform 51-7. Table shows the number of main liquid droplets when 100 μs elapses from the end of application of the last discharge pulse at this time. According to the driving waveform 51-7, seven main liquid droplets are discharged, but several main liquid droplets merge with each other after 100 μs elapses. As a result, the number of main liquid droplets is less than seven. Table 2 shows the number of main liquid droplets after mergence. For example, in Table 2, under the condition that the number of main liquid droplets is one, all the seven main liquid droplets merge into one main liquid droplet in a period of time of 100 μs. Minute liquid droplets called satellites may be generated at the rear of the main liquid droplet, but the number of satellites is not included in the number of main liquid droplets in Table 2.

TABLE 2 the number of main liquid droplets after 100 μs elapses since application of last discharge pulse in the driving waveform 51-7

| | | Sp/UL | | |
|---|---|---|---|---|
| | | 0.8 | 0.7 | 0.6 |
| UL (μs) | 2.1 | 2 | 3 | 2 |
| | 2.0 | 1 | 1 | 1 |
| | 1.9 | 3 | 3 | 1 |

dpA = UL
dpB = UL
cp = 0.4UL

When the time interval UL is approximately 2.0 μs which is substantially the same as AL, the speed of the liquid droplet in the second half gradually increases due to the strengthening of the pressure oscillation. Therefore, as shown in Table 2, when the time interval UL is 2.0 μs which is substantially the same as AL, all the main liquid droplets merge into one main liquid droplet regardless of sp/UL.

Experiment 3

The liquid droplets are discharged by the inkjet head 10 of the example according to the driving waveform 51-7. A magnification of the speed of the last main liquid droplet to that of the preceding main liquid droplet at this time (hereinafter, "magnification of the speed of the last main liquid droplet to the speed of the preceding main liquid droplet" is referred to as "speed magnification") is shown in Table 3. The speed of the preceding main liquid droplet is calculated from a distance of the preceding main liquid droplet from the nozzle 101 when 100 μs elapses from the end of application of the first discharge pulse. The speed of the last main liquid droplet is calculated from a distance of the main liquid droplet discharged according to the last discharge pulse from the nozzle 101 when 100 μs elapses from the end of application of the last discharge pulse. Specifically, the speed multiplication=(distance of the main liquid droplet discharged according to the last discharge pulse from the nozzle 101 when 100 μs elapses from the end of application of the last discharge pulse)/(distance of the preceding main liquid droplet from the nozzle 101 when 100 μs elapses from the end of application of the first discharge pulse). As shown in Experiment 2, the seven main liquid droplets discharged according to the driving waveform 51-7 merge with each other over time. When the main liquid droplets merge with each other, the speed is calculated from the distance of the main liquid droplet after mergence containing the main liquid droplet to be measured from the nozzle 101.

TABLE 3 magnification of speed of last main liquid droplet to speed of proceeding main liquid droplet discharged according to driving waveform 51-7

| | | Sp/UL | | |
|---|---|---|---|---|
| | | 0.8 | 0.7 | 0.6 |
| UL (μs) | 2.1 | 1.19 | 1.16 | 1.19 |
| | 2.0 | 1.25 | 1.27 | 1.29 |
| | 1.9 | 0.88 | 1.12 | 1.26 |

dpA = UL
dpB = UL
cp = 0.4UL

As can be known from Table 3, when sp/UL decreases, the speed magnification of the speed of the last main liquid droplet to that of the preceding main liquid droplet increases. As shown in Table 3, when the time interval UL is 1.9 μs, as compared with the case in which the time interval UL is 2.0 μs, the speed magnification of the speed of the last main liquid droplet to that of the preceding main liquid droplet decreases. From Table 3, it can be known that the change in the speed magnification is smaller when the time interval UL is 2.0 μs as compared with a case in which the time interval UL is 1.9 μs. This is because when the time interval UL is 1.9 μs, the speed of the subsequent main liquid droplet mainly increases due to the decrease of sp/UL, whereas when UL is 2.0 μs, not only does the speed of the subsequent main liquid droplet increase due to the decrease of sp/UL, but also the speed of the proceeding main liquid droplet increases as the subsequent main liquid droplet merges with the preceding main liquid droplet.

As can be known from Table 3, when UL is 2.1 μs, the speed magnification is the smallest when sp/UL is 0.7. This is because the strengthening of the pressure oscillation at the time of discharging the proceeding liquid droplet correspondingly increases since the time interval from the start of the application of the oscillation pulse to the end of the application of the first discharge pulse is about 2AL (about 4.0 μs) when UL is 2.1 μs and sp/UL is 0.7. This is because the time interval from the start of the application of the oscillation pulse to the end of the application of the seventh discharge pulse does not become a multiple of 2AL.

As can be known from Tables 2 and 3, when the speed multiplication is 1.25 or more, the number of main liquid droplets after mergence is one. When the speed magnification is 1.19 or more, the number of main liquid droplets after mergence becomes two or less. When the speed multiplication is 1.16 or more, the number of main liquid droplets after mergence becomes three or less.

Next, a case is considered in which there are nozzles with different number of liquid droplets to be consecutively discharged among a plurality of nozzles in a nozzle row. For example, a case is considered in which seven liquid droplets are discharged from a nozzle 101*f* and one liquid droplet is discharged from the adjacent nozzle 101*d* in FIG. 7. As can be known from the driving waveform 51-7 and the driving waveform 51-1 in FIG. 11, the seventh discharge pulse in the driving waveform 51-7 and the first discharge pulse in the driving waveform 51-1 are applied at the same timing. Therefore, it is considered that the last (seventh) liquid droplet discharged from the nozzle 101*f* and the last (first) liquid droplet discharged from the nozzle 101*d* are discharged at the same time. It is desirable that the speed difference between the speed of the last liquid droplet discharged from the nozzle 101*f* and the speed of the last liquid droplet discharged from the nozzle 101*d* is as small as possible so as to reduce the shift in the landing position of the liquid droplets on the image forming medium S. In consideration of this point, if the waveform parameter is selected, the condition that "UL=1.9 μs and sp/UL=0.7" is preferable, under which a numerical value of the result in Table 3 is 1 or more and close to 1.

Figure 12:
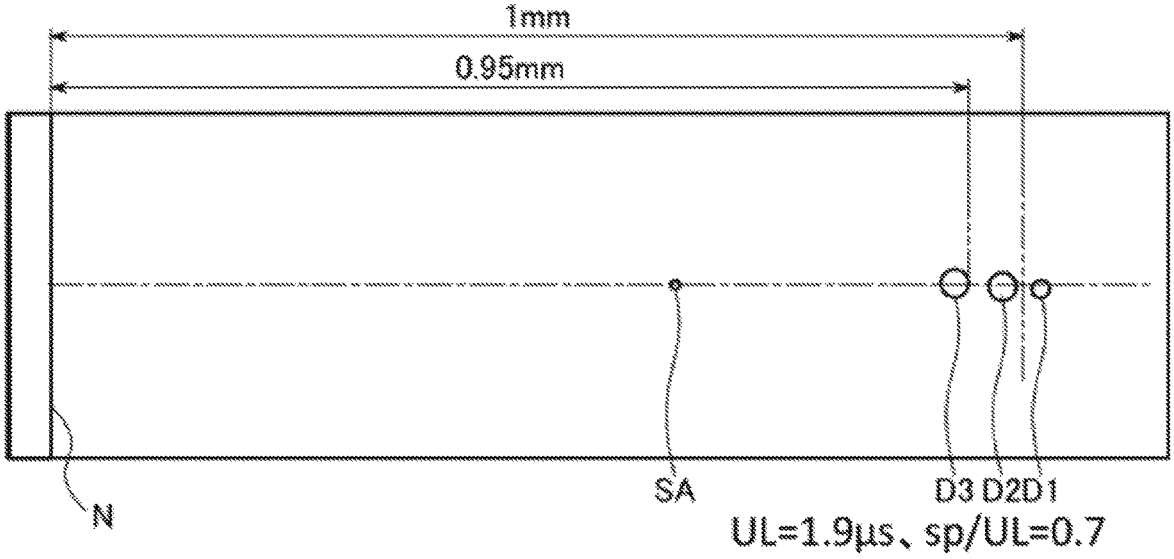
FIG. 12 is a diagram illustrating a contour of a liquid droplet in a discharge observation photograph.

When the liquid droplets are discharged under the condition that "UL=1.9 μs and sp/UL=0.7" in Table 3, FIG. 12 shows a drawing for describing a contour line of the liquid droplet in a discharge observation photograph captured when 100 μs elapses from the end of the application of the last discharge pulse. A liquid droplet D is discharged from a nozzle surface N and flies to the right side. The rightmost liquid droplet D1 is the preceding main liquid droplet, and does not merge with the subsequent main liquid droplet. The liquid droplet D2 on the left side of the liquid droplet D1 is a main liquid droplet in which the second discharged main liquid droplet to the fourth discharged main liquid droplet merge together. The liquid droplet D3 on the left side of the liquid droplet D2 is a main liquid droplet in which the fifth discharged main liquid droplet to the seventh discharged main liquid droplet merge together. The right end of the liquid droplet D3 is positioned at a distance of 0.95 mm from the nozzle surface N. The speed of the liquid droplet D3 including the seventh main liquid droplet (last main liquid droplet) is 9.5 m/s. The small liquid droplet SA is a satellite.

Figure 13:
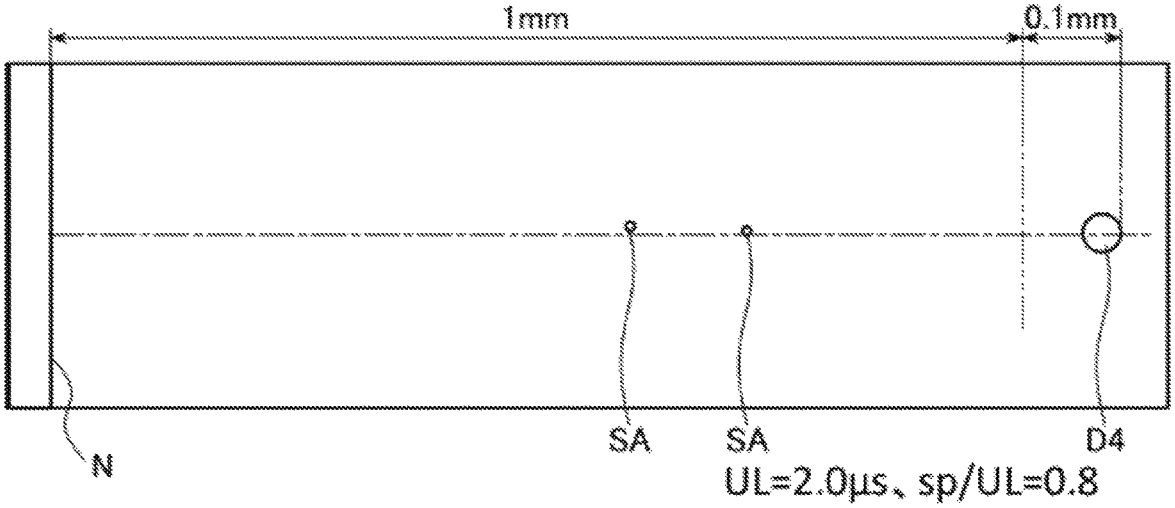
FIG. 13 is a diagram illustrating a contour of the liquid droplet in the discharge observation photograph.

In consideration of the power saving of the inkjet head 10, the condition in which the voltage V1 is 18.2 V which is the smallest in Table 1 is suitable. FIG. 13 shows a drawing for describing a contour line of the liquid droplet in a discharge observation photograph captured when 100 μs elapses from the end of the application of the last discharge pulse in a case in which the voltage V1 is 18.2 V and the number of liquid droplets in Table 2 is one, and the liquid droplet is discharged under the condition that "UL=2.0 μs and sp/UL=0.8" in Table 2. In FIG. 13, all the seven main liquid droplets merge into one liquid droplet D4. The right end of the liquid droplet D4 is positioned at a distance of 1.1 mm from the nozzle surface N. The speed of the liquid droplet D4 including the seventh main liquid droplet (last main liquid droplet) is 11 m/s.

Figure 14:
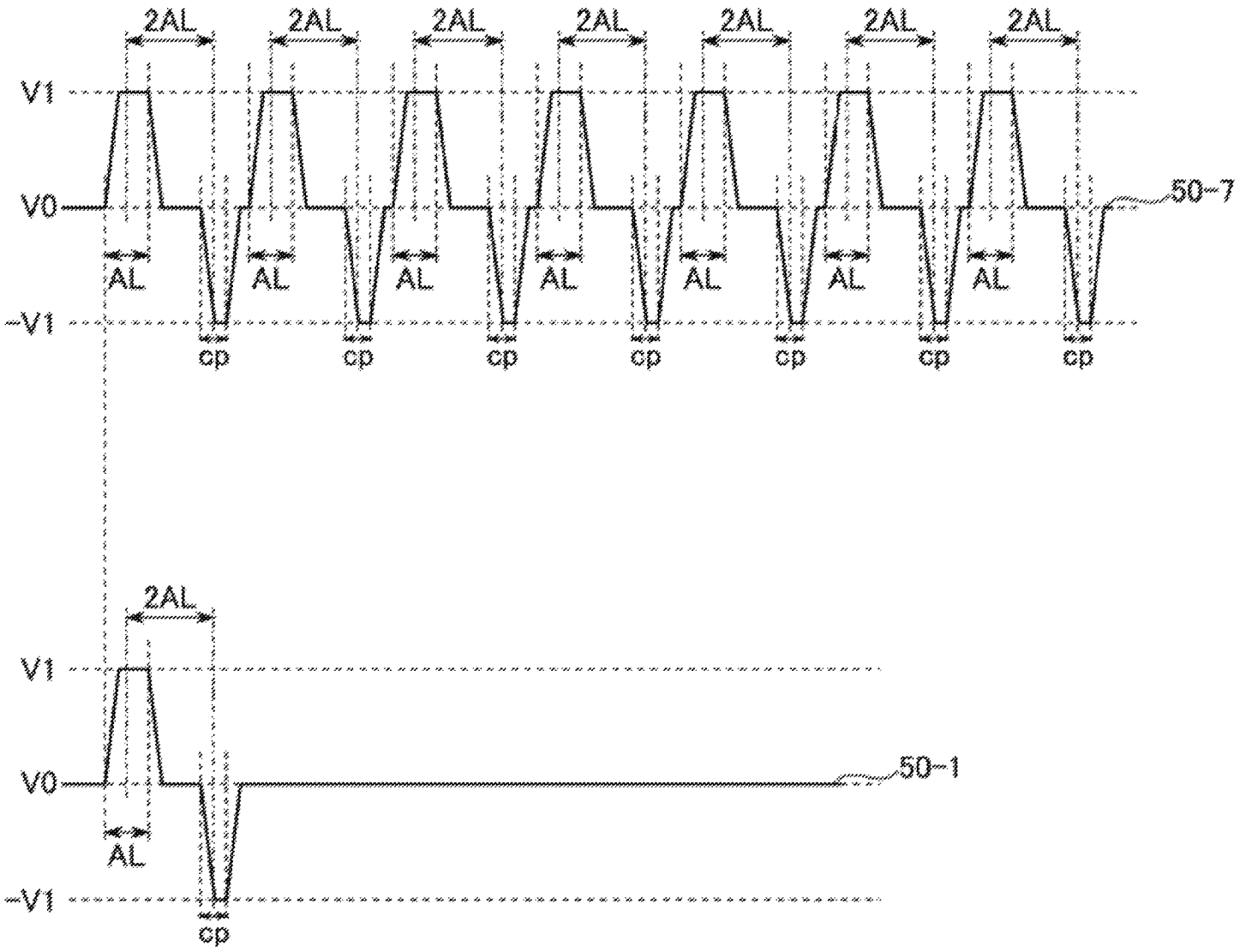
FIG. 14 is a diagram illustrating an example of a conventional driving waveform.

FIG. 14 shows an example of a conventional driving waveform. A driving waveform 50-7 is an example of a conventional driving waveform when seven liquid droplets are consecutively discharged. A driving waveform 50-1 is an example of a conventional driving waveform in the case in which one liquid droplet is discharged. The illustration of the driving waveform 50-2 to the driving waveform 50-6 when the number of liquid droplets to be consecutively discharged is two to six is omitted. The driving waveform 50-1 to the driving waveform 50-7 are collectively referred to as a driving waveform 50.

As shown in the driving waveform 50-7, in the conventional driving waveform 50, one liquid droplet is discharged with a trapezoidal wave having a width of AL at the voltage V1, and the residual oscillation in the pressure chamber is counteracted with a trapezoidal wave having a width of cp at the voltage—V1 immediately thereafter. The conventional driving waveform 50 repeats those trapezoidal waves by the number of liquid droplets to be consecutively discharged.

Therefore, in the inkjet head 10 of the first embodiment, the time taken to consecutively discharge a plurality of liquid droplets is shorter than that taken in the prior art. Specifically, the driving frequency of the inkjet head 10 of the first embodiment is improved as compared with the prior art.

The voltage V1 at which the discharge speed of the liquid droplet according to the driving waveform 50-1 is about 8.5 m/s is 27.1 V.

Therefore, according to the inkjet head 10 of the first embodiment, the voltage V1 can be considerably reduced as compared with the prior art. In other words, the power consumption of the inkjet head 10 of the first embodiment is lower than that in the prior art.

This is because in the driving waveform 51, the next discharge pulse is applied to strengthen the pressure oscillation in accordance with the pressure oscillation generated by the oscillation pulse before discharge of the liquid droplet or the pressure oscillation generated at the time of discharging the liquid droplet. As a result, the insufficiency of the discharge force for discharging the liquid droplet is compensated. On the other hand, according to the driving waveform 50 in FIG. 14, since the pressure oscillation is counteracted with the trapezoidal wave having the width of cp each time one main liquid droplet is discharged, it is necessary to ensure the discharge force sufficient for discharging the liquid droplet only with the trapezoidal waveform having the width of AL, and as a result, the voltage V1 of the driving waveform 50 is considerably larger than the voltage in Table 1.

As described above, the circuit connecting the voltage source, the drive circuit, the wiring electrode and the actuator can be considered as the RC series circuit. The power consumption of the RC series circuit is proportional to the number of trapezoidal waves (pulses) and the square of voltage. When the number of consecutively discharged liquid droplets is seven, the number of trapezoidal waves of the driving waveform 50-7 is fourteen, and the number of trapezoidal waves of the driving waveform 51-7 is nine. If the power consumption in the case of the driving waveform 50-7 and that in the case of the driving waveform 51-7 are compared under the condition that "UL=2.0 μs and sp/UL=0.8", the power consumption in the case of the driving waveform 51-7 is about 29% of that in the case of the driving waveform 50-7, and power consumption reduction of 70% or more becomes possible.

The inkjet head 10 of the first embodiment operates with two voltage sources including the first voltage source 40 and the second voltage source 41. In this manner, since the inkjet head 10 can operate with less voltage sources, the inkjet head 10 of the first embodiment can be manufactured at a lower cost than the prior art.

Further, in the inkjet head 10 of the first embodiment, the number of main liquid droplets after mergence can be reduced. Therefore, the image quality can be improved according to the inkjet head 10 of the first embodiment.

Second Embodiment

The configuration of the inkjet recording apparatus 1 according to the second embodiment is the same as that of the first embodiment shown in FIG. 1 to FIG. 6. Therefore, the description thereof is omitted.

Figure 15:
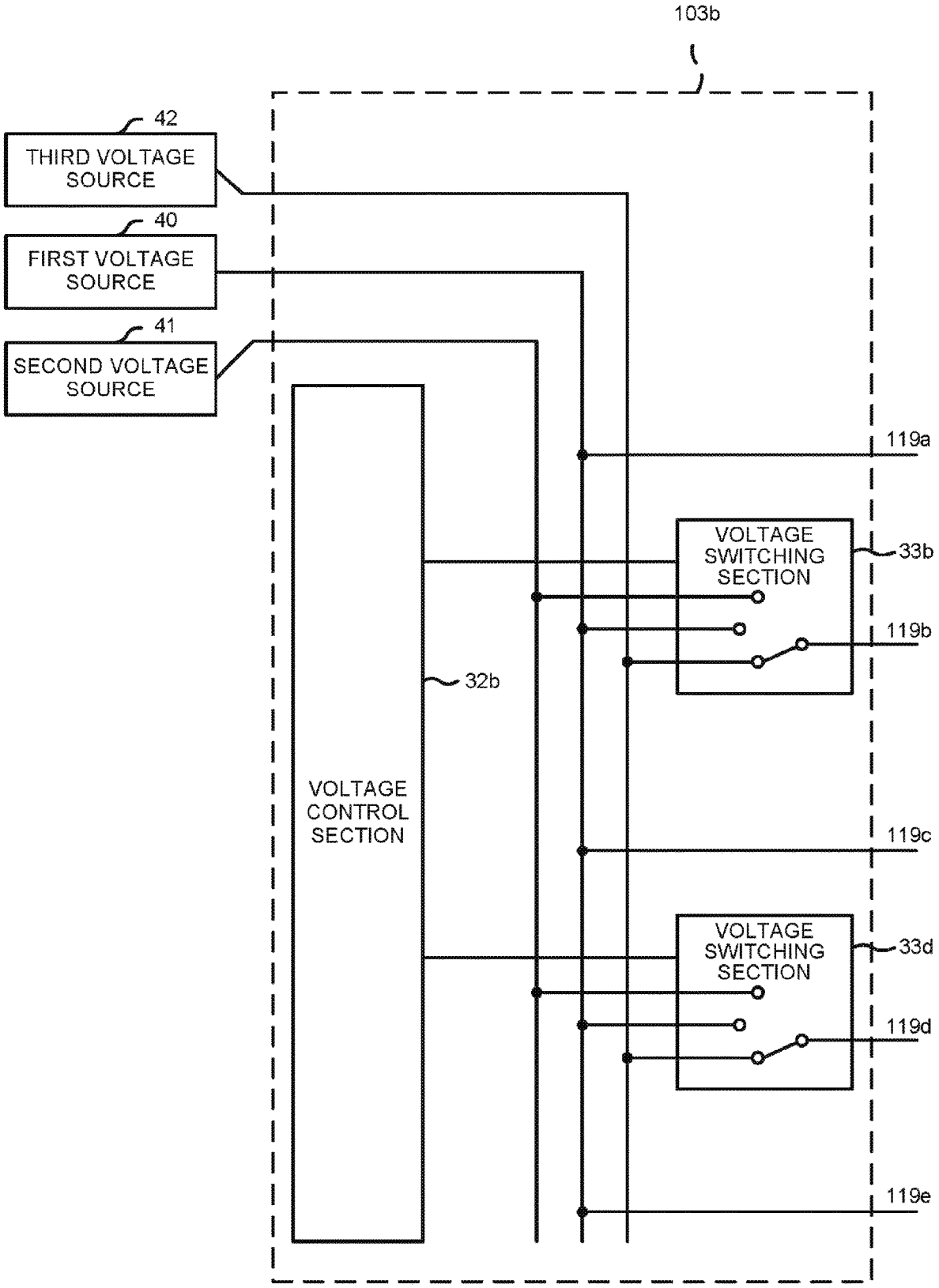
FIG. 15 is a diagram illustrating an example of a configuration of a drive circuit according to the second embodiment.

However, the inkjet recording apparatus 1 of the second embodiment has a drive circuit 103*b* as shown in FIG. 15 instead of the drive circuit 103 in FIG. 10. FIG. 15 is a diagram illustrating an example of a configuration of the drive circuit 103*b*. The drive circuit 103*b* has voltage switching sections 33 the number of which is same as that of the pressure chambers 115 in the inkjet head 10. In the example of the configuration shown in FIG. 15, voltage switching sections 33*b* and 33*d* are shown. The drive circuit 103*b* comprises a voltage control section 32*b*.

The drive circuit 103*b* is connected to the first voltage source 40, the second voltage source 41 and a third voltage source 42. The drive circuit 103*b* selectively applies the voltage supplied from the first voltage source 40, the second voltage source 41 and the third voltage source 42 to the wiring electrodes 119*b* and 119*d*. An output voltage of the third voltage source 42 is –V1. The third voltage source provides a second voltage amplitude for use in the oscillation pulse and the suppression pulse.

The voltage switching section 33*b* connects one of the first voltage source 40, the second voltage source 41 and the third voltage source 42 to the wiring electrode 119*b* under the control of the voltage control section 32*b*. The voltage switching section 33*d* connects one of the first voltage source 40, the second voltage source 41 and the third voltage source 42 to the wiring electrode 119*d* under the control of the voltage control section 32*b*. The same is applicable to a voltage switching section 33*f*, a voltage switching section 33*h*, . . . . The wiring electrode 119*b* is connected to an electrode 120*b* on the inner wall of the pressure chamber, and the wiring electrode 119*d* is connected to an electrode 120*d* on the inner wall of the pressure chamber. The same is applicable to the wiring electrode 119*f*, the wiring electrode 119*h*, . . . . On the other hand, the electrodes 120*a*, 120*c*, 120*e*, . . . . On the inner wall of the air chambers are connected to the first voltage source 40 via the wiring electrodes 119*a*, 119*c*, 119*e*, . . . .

In the example in FIG. 15, the wiring electrode 119 connected to the electrode 120 on the inner wall of the air chamber is also connected to the first voltage source 40 in the drive circuit 103*b*. However, the wiring electrode may be connected to the first voltage source 40 at the outside of the drive circuit. In this case, the wiring electrode connected to the drive circuit is only connected to the electrode on the inner wall of the pressure chamber.

The third voltage source 42 is an example of a third voltage source. The drive circuit 103*b* is an example of the applying section.

Figure 16:
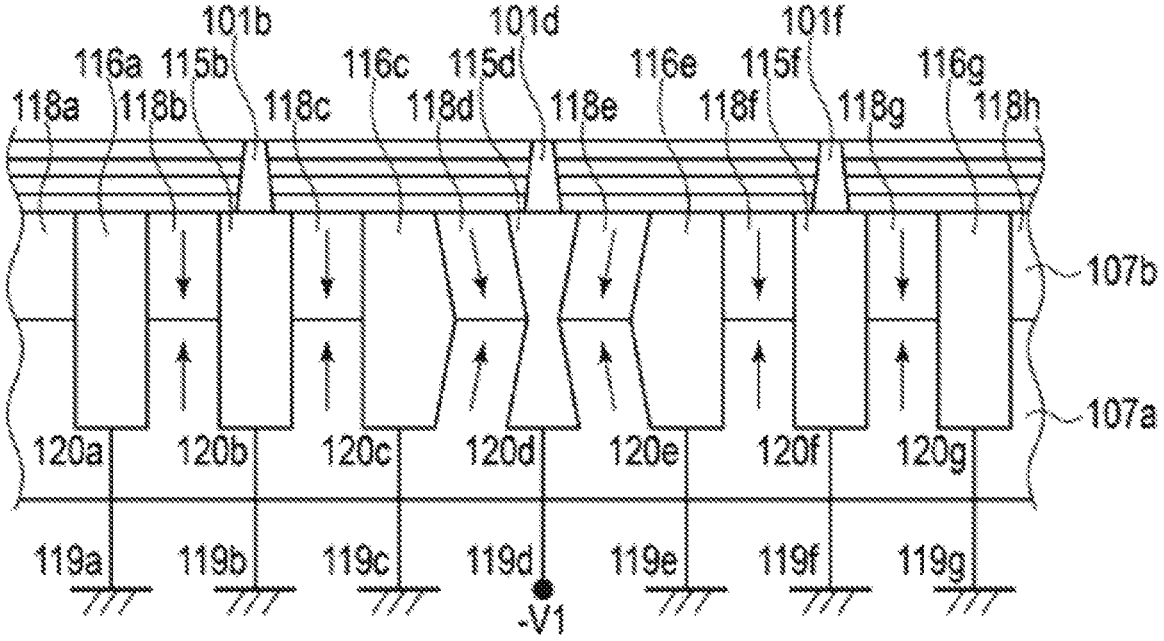
FIG. 16 is a diagram illustrating a state in which one pressure chamber is contracted.

In the second embodiment, the drive circuit 103*b* changes the state of the pressure chamber to a state shown in FIG. 16 instead of the state of the pressure chamber to the state shown in FIG. 9 changed by the drive circuit 103 of the first embodiment.

In FIG. 16, the volume of the pressure chamber 115*d* is contracted. In FIG. 16, the actuator 118*d* and the actuator 118*e* are deformed into shapes opposite to those shown in FIG. 8.

FIG. 16 shows the head substrate 102 in a state in which the voltage applied to the electrode 120*d* is −V1 and the voltages applied to the other electrodes 120*a* to 120*c* and the electrodes 120*e* to 120*g* are the ground voltage. Even in the state shown in FIG. 16, a potential difference opposite to that in FIG. 8 is generated between the electrode 120*d* and the adjacent electrodes 120*c* and 120*e*. Due to the potential difference, shearing deformations in directions opposite to those shown in FIG. 8 occur in the actuator 118*d* and the actuator 118*e*.

When the oscillation pulse or the suppression pulse is applied to the pressure chamber 115*d* communicating with the nozzle 101*d* shown in FIG. 16, the drive circuit 103*b* applies a voltage of −V1 to the electrode 120*d* as shown in FIG. 16. Specifically, the drive circuit 103*b* can apply the oscillation pulse or the suppression pulse to the adjacent pressure chamber 115*d* while applying the discharge pulse to the pressure chamber 115*f*, for example. Therefore, as shown in FIG. 17, the start of application of the driving waveform in the case in which one to six liquid droplets are consecutively discharged can be advanced as compared with the first embodiment.

Figure 17:
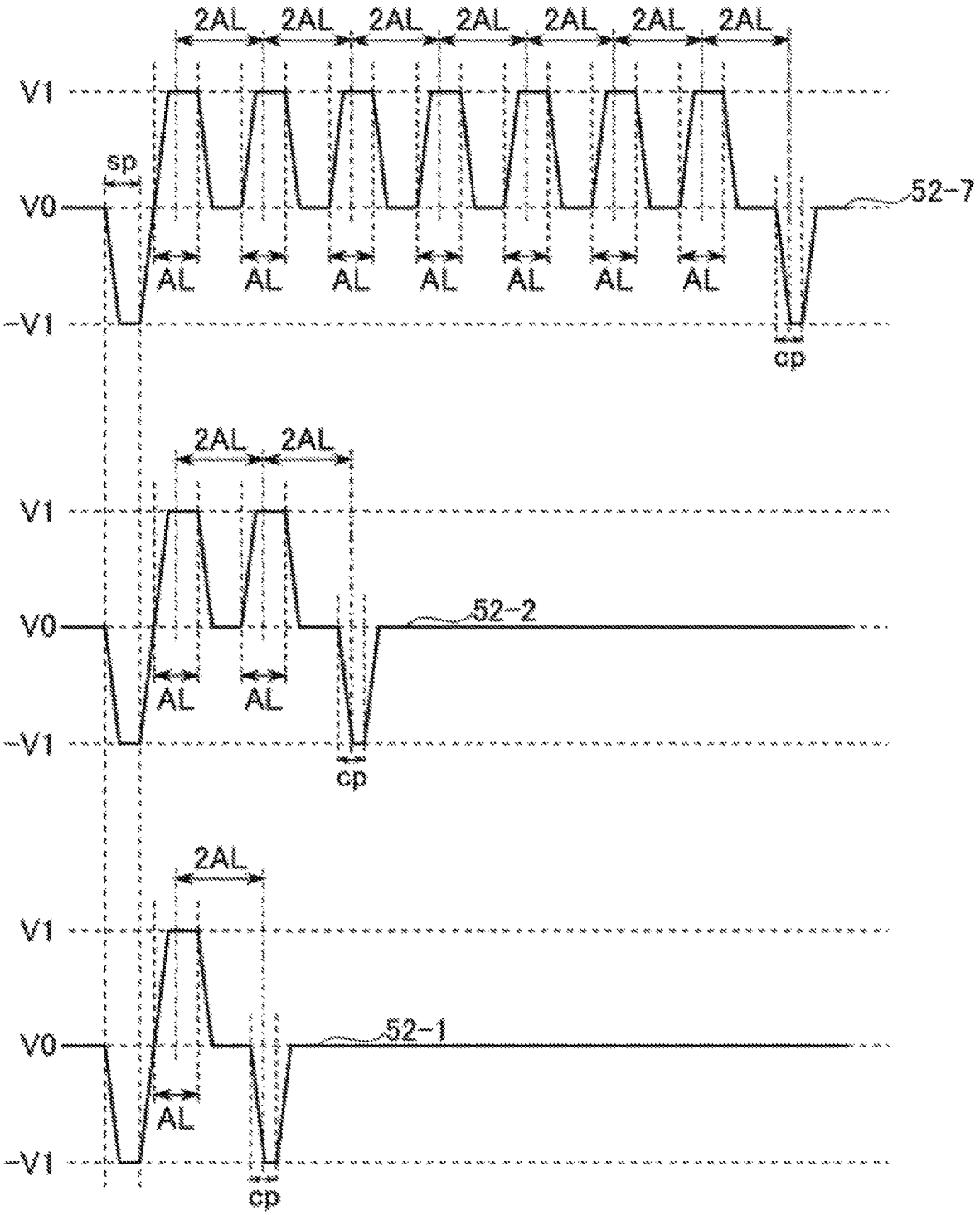
FIG. 17 is a diagram illustrating an example of a driving waveform according to the second embodiment.

FIG. 17 is a diagram illustrating an example of the driving waveform of a driving signal that the drive circuit 103*b* applies to the electrode 120. A driving waveform 52-7 is the driving waveform when the number of consecutively discharged liquid droplets is seven. A driving waveform 52-2 is the driving waveform when the number of liquid droplets to be consecutively discharged is two. A driving waveform 52-1 is the driving waveform when the number of liquid droplets to be discharged is one. The illustration of the driving waveform 52-3 to the driving waveform 52-6 when the number of liquid droplets to be consecutively discharged is three to six is omitted. The driving waveform 52-1 to the driving waveform 52-7 are collectively referred to as a driving waveform 52.

A case is considered in which there are nozzles with different number of liquid droplets to be consecutively discharged among the plurality of nozzles in the nozzle row of the inkjet head 10 driven according to the driving waveform 52 as shown in FIG. 17. For example, a case is considered in which seven liquid droplets are discharged from the nozzle 101*f* and one liquid droplet is discharged from the adjacent nozzle 101*d* in FIG. 7. As can be known from the driving waveform 52-7 and the driving waveform 52-1 in FIG. 17, the waveform up to the first discharge pulse in the driving waveform 52-7 and the waveform up to the first discharge pulse in the driving waveform 52-1 are the same. Therefore, a difference in the discharge speeds of the proceeding liquid droplets discharged from both nozzles including the nozzle 101*f* and the nozzle 101*d* is small. Therefore, if the waveform parameter is selected, the condition that "UL=2.0 μs and sp/UL=0.8" is preferable, under which a numerical value of the result in Table 2 is one and a numerical value of the result in Table 3 is one or more, and the power consumption is reduced.

As in the first embodiment, the inkjet head 10 of the second embodiment can improve the driving frequency and reduce the power consumption.

The inkjet head 10 of the second embodiment can advance the start of the application of the driving waveform as described above as compared with the first embodiment. Therefore, the inkjet head 10 of the second embodiment can select the waveform parameter at which the liquid droplets can easily merge with each other even if seven liquid droplets are consecutively discharged, and can reduce the shift in the landing positions of the seven liquid droplets consecutively discharged.

Third Embodiment

The configuration of the inkjet recording apparatus 1 according to the third embodiment is the same as that of the inkjet recording apparatus 1 of the first embodiment or the second embodiment. Therefore, the description of the configuration of the inkjet recording apparatus 1 according to the third embodiment is omitted.

Figure 18:
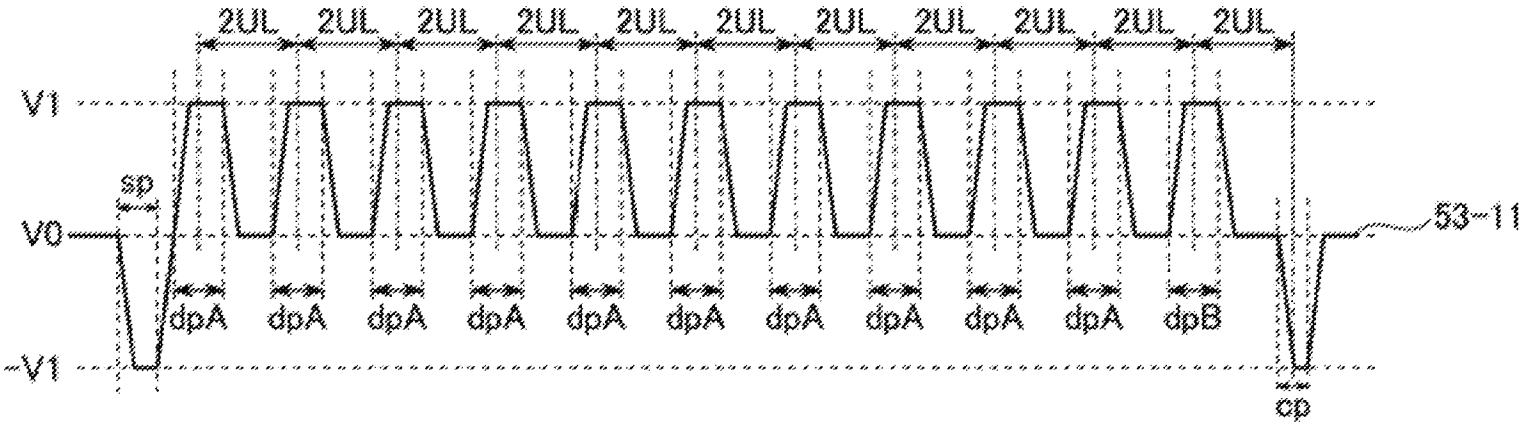
FIG. 18 is a diagram illustrating an example of a driving waveform according to the third embodiment.

In the third embodiment, a case in which the number of gradations of an image formed on the image forming medium S is increased from eight grades is considered. For example, a case in which the number of main liquid droplets to be consecutively discharged is eleven is considered. FIG. 18 is a diagram illustrating an example of the driving waveform in the case of consecutively discharging eleven liquid droplets.

The driving waveform 53-11 is an example of the driving waveform when eleven liquid droplets are consecutively discharged.

Example

Experiment 4

The liquid droplet is discharged by the inkjet head 10 of the above-described example according to the driving waveform 53-11 under the condition that "UL=2.0 μs and sp/UL=0.8". Table 4 shows the number of main liquid droplets when 100 μs elapses from the end of application of the last discharge pulse at this time.

TABLE 4 various values for liquid droplets discharged according to driving waveform 53-11

| | Speed of main liquid droplet (m/s) | | The number of main liquid droplets after | |
|---|---|---|---|---|
| dpA | Proceeding main liquid droplet | Last main liquid droplet | 100 μs elapses since application of last discharge pulse | Voltage V1 (V) |
| UL | 9.0 | 11.5 | 2 | 18.2 |
| 0.8UL | 8.4 | 12.4 | 1 | 18.4 |

Sp/dpA = 0.8
dpB = UL = 2.0 μs
cp = 0.4UL

As a result, the number of main liquid droplets when 100 μs elapses from the end of application of the last discharge pulse (the eleventh discharge pulse) is two. The preceding main liquid droplet at this time is a main liquid droplet in which the first to the eighth main liquid droplets merge with each other. Then, the subsequent main liquid droplet (the last main liquid droplet) is a main liquid droplet in which the ninth to eleventh main liquid droplets merge with each other. The speed of the preceding main liquid droplet at this time is 9.0 m/s. The speed of the last main liquid droplet is 11.5 m/s.

Here, the driving waveform is considered in which all eleven main liquid droplets consecutively discharged merge together. For example, the inkjet head is driven with the driving waveform in which a width of the discharge pulse for discharging the first half of the liquid droplets is smaller or larger than AL, and a width of the discharge pulse for discharging the second half of the liquid droplets is closer to AL compared with the previous discharge pulse among the eleven discharge pulses. In this case, the width of the last discharge pulse among the plurality of discharge pulses is closest to AL. As a specific example, the liquid droplet is discharged according to the driving waveform 53-11 under the condition that "dpA=1.6 μs, sp/dpA=0.8, UL=2.0 μs, dpB=UL, cp=0.4UL". The results are shown in Table 4. As a result, the number of main liquid droplets when 100 μs elapses from the end of application of the last discharge pulse (the eleventh discharge pulse) is one. The speed of the preceding main liquid droplet at this time is 8.4 m/s. The speed of the last main liquid droplet is 12.4 m/s.

The inkjet head 10 according to the third embodiment can discharge less main liquid droplets after mergence as compared with the first embodiment and the second embodiment even if the number of gradations is increased. Therefore, the inkjet head 10 of the third embodiment can improve the image quality when the number of gradations is increased, as compared with the first embodiment and the second embodiment.

The above embodiments may also be modified as follows.

The inkjet recording apparatus 1 of the embodiment is an inkjet printer which forms a two-dimensional image with ink on the image forming medium S. However, the inkjet recording apparatus of the embodiment is not limited thereto. The inkjet recording apparatus of the embodiment may be, for example, a 3D (three-dimensional) printer, an industrial manufacturing machine, a medical machine, or the like. If the inkjet recording apparatus of the embodiment is the 3D printer, the industrial manufacturing machine, the medical machine, or the like, the inkjet recording apparatus of the embodiment may discharge binder or the like for binding material substance or material from the inkjet head thereof to form a three-dimensional object.

The inkjet recording apparatus 1 of the embodiment has four liquid discharging sections 2, and the colors of the ink I respectively used by the liquid discharge sections 2 are cyan, magenta, yellow and black. However, the number of the liquid discharge sections 2 of the inkjet recording apparatus is not limited to four, and may be a single one. The colors and properties of the ink I respectively used by the liquid discharge sections 2 are not limited.

The liquid discharge section 2 may discharge transparent glossy ink, ink that develops color when irradiated with infrared rays or ultraviolet rays, or other special ink. Furthermore, the liquid discharge section 2 may discharge a liquid other than the ink. The liquid discharged by the liquid discharge section 2 may be dispersion such as suspension or the like. The liquid other than the ink discharged by the liquid discharge section 2 may be, for example, liquid containing conductive particles for forming a wiring pattern of a printed wiring board, liquid containing cells for artificially forming a tissue or an organ, binder such as adhesive, wax, liquid resin or the like.

In the inkjet recording apparatus 1 of the third embodiment, only the width of the last discharge pulse is dpB, and the width of the other discharge pulses is dpA. However, the width of each discharge pulse up to the last discharge pulse from any one of discharge pulses among the second discharge pulse to the one before the last discharge pulse may be dpB. The width of the discharge pulse from the first discharge pulse to the last discharge pulse may gradually approach to AL. In the above case, the last discharge pulse among the plurality of discharge pulses is closest to AL as well.

In each of the numerical values in the above embodiments, an error within a range at which the object of the present invention can be achieved is allowed.

With respect to any figure or numerical range for a given characteristic, a figure or a parameter from one range may be combined with another figure or a parameter from a different range for the same characteristic to generate a numerical range.

Other than in the operating examples, if any, or where otherwise indicated, all numbers, values and/or expressions referring to parameters, measurements, conditions, etc., used in the specification and claims are to be understood as modified in all instances by the term "about."

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An inkjet head, comprising:

a pressure chamber configured to store liquid;

an actuator configured to change a volume of the pressure chamber in response to an applied driving signal; and an applying section configured to apply the driving signal to the actuator, wherein the driving signal comprises a discharge pulse for discharging liquid from a nozzle communicating with the pressure chamber and an oscillation pulse, applied before the discharge pulse, configured to have a potential opposite in polarity to that of the discharge pulse to generate pressure oscillation for promoting discharge of the liquid, and when the driving signal includes two or more successive discharge pulses, a cycle of the discharge pulse is 1.5 times or more and 2.5 times or less as long as a half cycle of a main acoustic resonance frequency of the liquid in the pressure chamber.

2. The inkjet head according to claim 1, wherein the actuator comprises a first electrode and a second electrode, and the applying section applies the discharge pulse to the actuator by connecting a second voltage source to the first electrode and a first voltage source to the second electrode, and applies the oscillation pulse to the actuator by connecting the first voltage source to the first electrode and connecting the second voltage source to the second electrode.

3. The inkjet head according to claim 1, wherein the actuator comprises a first electrode and a second electrode, and the applying section applies the discharge pulse to the actuator by connecting a second voltage source to the first electrode and a first voltage source to the second electrode, and applies the oscillation pulse to the actuator by connecting a third voltage source to the first electrode and connecting the first voltage source to the second electrode.

4. The inkjet head according to claim 1, wherein the oscillation pulse has a width for making a speed of a liquid droplet discharged according to a last discharge pulse equal to or greater than a speed of a liquid droplet discharged according to a first discharge pulse if the driving signal comprises two or more consecutive discharge pulses.

5. The inkjet head according to claim 1, wherein when the driving signal comprises two or more consecutive discharge pulses, a width of a last discharge pulse is closest to a half cycle of a main acoustic resonance frequency among the widths of the discharge pulses.

6. The inkjet head according to claim 1, wherein the cycle of the discharge pulse is 1.75 times or more and 2.25 times or less as long as a half cycle of a main acoustic resonance frequency of the liquid in the pressure chamber.

7. The inkjet head according to claim 1, wherein the liquid is inkjet printing ink.

8. An inkjet recording apparatus, comprising:

an inkjet head; and an ink supply device configured to supply liquid to the inkjet head, wherein the inkjet head comprising:

a pressure chamber configured to store liquid;

an actuator configured to change a volume of the pressure chamber in response to an applied driving signal; and an applying section configured to apply the driving signal to the actuator, wherein the driving signal comprises a discharge pulse for discharging liquid from a nozzle communicating with the pressure chamber and an oscillation pulse, applied before the discharge pulse, configured to have a potential opposite in polarity to that of the discharge pulse to generate pressure oscillation for promoting discharge of the liquid, and when the driving signal includes two or more successive discharge pulses, a cycle of the discharge pulse is 1.5 times or more and 2.5 times or less as long as a half cycle of a main acoustic resonance frequency of the liquid in the pressure chamber.

9. The inkjet recording apparatus according to claim 8, wherein the actuator comprises a first electrode and a second electrode, and the applying section applies the discharge pulse to the actuator by connecting a second voltage source to the first electrode and a first voltage source to the second electrode, and applies the oscillation pulse to the actuator by connecting the first voltage source to the first electrode and connecting the second voltage source to the second electrode.

10. The inkjet recording apparatus according to claim 8, wherein the actuator comprises a first electrode and a second electrode, and the applying section applies the discharge pulse to the actuator by connecting a second voltage source to the first electrode and a first voltage source to the second electrode, and applies the oscillation pulse to the actuator by connecting a third voltage source to the first electrode and connecting the first voltage source to the second electrode.

11. The inkjet recording apparatus according to claim 8, wherein the oscillation pulse has a width for making a speed of a liquid droplet discharged according to a last discharge pulse equal to or greater than a speed of a liquid droplet discharged according to a first discharge pulse if the driving signal comprises two or more consecutive discharge pulses.

12. The inkjet recording apparatus according to claim 8, wherein when the driving signal comprises two or more consecutive discharge pulses, a width of a last discharge pulse is closest to a half cycle of a main acoustic resonance frequency among the widths of the discharge pulses.

13. The inkjet recording apparatus according to claim 8, wherein the cycle of the discharge pulse is 1.75 times or more and 2.25 times or less as long as a half cycle of a main acoustic resonance frequency of the liquid in the pressure chamber.

14. The inkjet recording apparatus according to claim 8, wherein the liquid is inkjet printing ink.

15. The inkjet recording apparatus according to claim 8, wherein the inkjet recording apparatus is an inkjet printer.

16. An ink discharging method, comprising:

applying a driving signal to an actuator configured to change a volume of a pressure chamber in response to an applied driving signal, the pressure chamber storing liquid, and the driving signal comprising a discharge pulse for discharging liquid from a nozzle communicating with the pressure chamber; and applying an oscillation pulse before the discharge pulse, the oscillation pulse having a potential opposite in polarity to that of the discharge pulse to generate pressure oscillation for promoting discharge of the liquid, wherein when the driving signal includes two or more successive discharge pulses, a cycle of the discharge pulse is 1.5 times or more and 2.5 times or less as long as a half cycle of a main acoustic resonance frequency of the liquid in the pressure chamber.

17. The method according to claim 16, further comprising:

applying the discharge pulse to the actuator by connecting a second voltage source to a first electrode of the actuator and a first voltage source to a second electrode of the actuator, and applying the oscillation pulse to the actuator by connecting the first voltage source to the first electrode of the actuator and connecting the second voltage source to the second electrode of the actuator.

18. The method according to claim 16, further comprising:

applying the discharge pulse to the actuator by connecting a second voltage source to a first electrode of the actuator and a first voltage source to a second electrode of the actuator, and applying the oscillation pulse to the actuator by connecting a third voltage source to the first electrode of the actuator and connecting the first voltage source to the second electrode of the actuator.

19. The method according to claim 16, wherein the oscillation pulse has a width for making a speed of a liquid droplet discharged according to a last discharge pulse equal to or greater than a speed of a liquid droplet discharged according to a first discharge pulse if the driving signal comprises two or more consecutive discharge pulses.

20. The method according to claim 16, wherein when the driving signal comprises two or more consecutive discharge pulses, a width of a last discharge pulse is closest to a half cycle of a main acoustic resonance frequency among the widths of the discharge pulses.

* * * * *